US010133233B2

(12) United States Patent
Murata

(10) Patent No.: US 10,133,233 B2
(45) Date of Patent: Nov. 20, 2018

(54) TONER CONTAINER CONFIGURED TO BE ATTACHABLE TO AND DETACHABLE FROM A TONER REPLENISHING PORTION AND A WASTE TONER COLLECTING PORTION

(71) Applicant: KYOCERA Document Solutions Inc., Osaka-shi, Osaka (JP)

(72) Inventor: Koji Murata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/735,930

(22) PCT Filed: May 6, 2016

(86) PCT No.: PCT/JP2016/063674

§ 371 (c)(1),
(2) Date: Dec. 12, 2017

(87) PCT Pub. No.: WO2016/208282

PCT Pub. Date: Dec. 29, 2016

(65) Prior Publication Data

US 2018/0173156 A1 Jun. 21, 2018

(30) Foreign Application Priority Data

Jun. 25, 2015 (JP) ..... 2015-128138

(51) Int. Cl.

| | |
|---|---|
| ***G03G 15/08*** | (2006.01) |
| ***G03G 21/16*** | (2006.01) |
| ***G03G 21/12*** | (2006.01) |

(52) U.S. Cl.
CPC ..... *G03G 21/1676* (2013.01); *G03G 15/08* (2013.01); *G03G 15/0867* (2013.01);
(Continued)

(58) Field of Classification Search
CPC . G03G 15/0865; G03G 15/0867; G03G 21/12
(Continued)

(56) References Cited

U.S. PATENT DOCUMENTS 9,625,871 B2 * 4/2017 Sato ..... G03G 15/0867

FOREIGN PATENT DOCUMENTS

JP 08114976 A 5/1996

* cited by examiner

*Primary Examiner* — William J Royer
(74) *Attorney, Agent, or Firm* — Alleman Hall Creasman & Tuttle LLP

(57) ABSTRACT

An image forming apparatus includes a toner replenishing portion, a waste toner collecting portion, and a toner container. The toner container is attachable to the toner replenishing portion and the waste toner collecting portion. The toner container includes a first lever switchable between first and second positions, and a second lever switchable between third and fourth positions. The toner replenishing portion includes a first actuating portion configured to, while the toner container is being attached to the toner replenishing portion, prohibit an attachment of the toner container, and a second actuating portion configured to switch the second lever to the fourth position. The waste toner collecting portion includes a third actuating portion configured to, while the toner container is being attached to the waste toner collecting portion, prohibit an attachment of the toner container, and a fourth actuating portion configured to switch the first lever to the second position.

10 Claims, 16 Drawing Sheets

(52) U.S. Cl.
CPC ..... *G03G 21/12* (2013.01); *G03G 21/16* (2013.01); *G03G 2215/066* (2013.01); *G03G 2221/163* (2013.01); *G03G 2221/1669* (2013.01); *G03G 2221/1815* (2013.01)

(58) Field of Classification Search
USPC ..... 399/120, 258, 262, 358, 360
See application file for complete search history.

TONER CONTAINER CONFIGURED TO BE ATTACHABLE TO AND DETACHABLE FROM A TONER REPLENISHING PORTION AND A WASTE TONER COLLECTING PORTION

TECHNICAL FIELD

The present invention relates to an image forming apparatus to which a toner container storing toner to be replenished and a toner container for storing collected waste toner can be attached.

BACKGROUND ART

A developing device is mounted in an electrophotographic image forming apparatus. Developer containing toner is stored inside the developing device. The developing device develops an electrostatic latent image formed on an image carrying member such as a photoconductor drum, by the toner contained in the developer. A toner image developed on the image carrying member is fixed to a print sheet by a fixing device. After the fixing, toner that was not fixed to the print sheet by the fixing device may remain on the image carrying member. With regard to this problem, there is known a waste toner collecting device for removing the toner remaining on the image carrying member and collecting the toner as waste toner.

The waste toner collecting device of this type includes a waste toner container for storing removed waste toner. Conventionally, there is known an image forming apparatus that can use, as a waste toner container, a toner replenishing container that had been used to replenish toner to the developing device and had become empty (see PTL 1). In this image forming apparatus, a configuration is made such that when the empty container is attached to the waste toner collecting device, a part of the empty container is deformed such that the deformed empty container cannot be attached to a replenishment attachment portion for the toner replenishing container. This prevents the empty container from being erroneously attached to the replenishment attachment portion, preventing waste toner from being erroneously used.

CITATION LIST

Patent Literature

[PTL 1] Japanese Patent Application Publication No. 118-114976

SUMMARY OF THE INVENTION

Problems to be Solved by the Invention

However, according to the conventional image forming apparatus, a part of the empty container is deformed. As a result, once an empty container is used as a waste toner container, the container cannot be used for the other purposes. In addition, according to the conventional image forming apparatus, a part of the empty container is broken. As a result, there is a possibility that a fragment broken off from the empty container may remain in the waste toner collecting device and obstruct the attachment or detachment of the waste toner container.

The present invention has been made in view of the above-described circumstances, and it is an object of the present invention to provide an image forming apparatus that allows a smooth insertion and removal of a toner container, and in which a toner container for replenishing toner and a toner container for collecting waste toner have a same configuration so that a same toner container can be used for both replenishing toner and collecting waste toner, while preventing the waste toner from being reused.

Solution to the Problems

An image forming apparatus according to an aspect of the present invention includes a toner replenishing portion, a waste toner collecting portion, and a toner container. The toner container is configured to be attachable to and detachable from the toner replenishing portion and the waste toner collecting portion. The toner container includes a first lever configured to be switchable between a first position and a second position, and a second lever configured to be switchable between a third position and a fourth position. The toner replenishing portion includes a first actuating portion configured to, during a process in which the toner container is attached to the toner replenishing portion, act on the toner container in which the first lever is disposed at the second position and prohibit an attachment of the toner container, and a second actuating portion configured to, during the process in which the toner container is attached to the toner replenishing portion, act on the second lever disposed at the third position and switch the second lever to the fourth position. The waste toner collecting portion includes a third actuating portion configured to, during a process in which the toner container is attached to the waste toner collecting portion, act on the second lever disposed at the third position and prohibit an attachment of the toner container, and a fourth actuating portion configured to, during the process in which the toner container is attached to the waste toner collecting portion, act on the first lever disposed at the first position and switch the first lever to the second position.

Advantageous Effects of the Invention

According to the present invention, it is possible to allow a smooth insertion and removal of a toner container, and make a toner container for replenishing toner and a toner container for collecting waste toner have a same configuration so that a same toner container can be used for both replenishing toner and collecting waste toner, while preventing the waste toner from being reused.

DESCRIPTION OF EMBODIMENTS

The following describes an image forming apparatus 10 according to an embodiment of the present invention with reference to the accompanying drawings. In the following description, an up-down direction D1 is defined based on a state where the image forming apparatus 10 is installed. In addition, a front-rear direction D2 is defined on a basis that a side of the image forming apparatus 10 on which a toner container 41 and a waste toner container 81 are inserted, is a front side. Furthermore, a left-right direction D3 is defined based on the image forming apparatus 10 viewed from the front side.

[Image Forming Apparatus]

The image forming apparatus 10 has at least a print function and is, for example, a color printer. The image forming apparatus 10 prints an image on a print sheet that is a sheet member, by using developer that contains toner. It is noted that a specific example of the image forming apparatus 10 is, for example, a printer, a copier, a facsimile, or a multifunction peripheral having functions of these apparatuses. In addition, although the image forming apparatus 10 is configured to form a color image, the image forming apparatus of the present invention may be configured to form a monochrome image.

Figure 1:
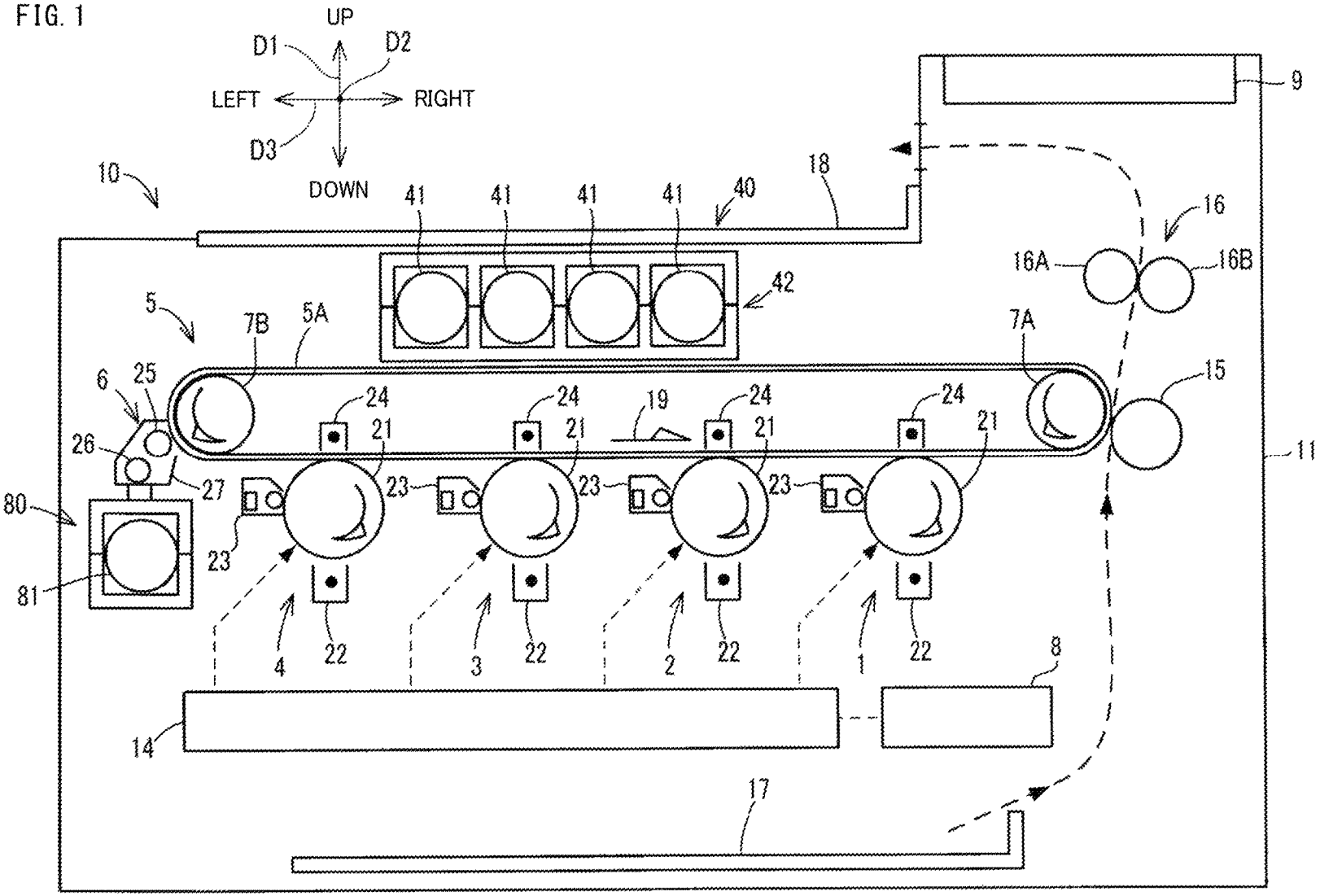
FIG. 1 is a diagram showing an image forming apparatus according to an embodiment of the present invention.

As shown in FIG. 1, the image forming apparatus 10 is a so-called tandem-system color image forming apparatus. The image forming apparatus 10 includes a plurality of image forming portions 1 to 4, an intermediate transfer unit 5, an exposure device 14, a secondary transfer device 15, a fixing device 16, a toner replenishing device 40 (an example of the toner replenishing portion of the present invention), a belt cleaning device 6, a waste toner collecting device 80 (an example of the waste toner collecting portion of the present invention), an operation/display portion 9 including a touch panel, a liquid crystal display portion and the like, a control portion 8, a sheet feed tray 17, and a sheet discharge tray 18. These components are attached to a housing 11 that constitutes an external frame (not shown), an internal frame and the like of the image forming apparatus 10.

The image forming portions 1 to 4 form, by a so-called electrophotographic system, toner images of different colors respectively on a plurality of photoconductor drums 21 that are arranged in alignment. The toner images are transferred to an intermediate transfer belt 5A while it is running (moving) such that the toner images are overlaid with each other thereon. In the example shown in FIG. 1, an image forming portion 1 for black, an image forming portion 2 for yellow, an image forming portion 3 for cyan, and an image forming portion 4 for magenta are arranged in alignment in the stated order from the downstream side in the moving direction (direction indicated by the arrow 19) of the intermediate transfer belt 5A.

The image forming portions 1 to 4 are provided below the intermediate transfer belt 5A. Each of the image forming portions 1 to 4 includes a photoconductor drum 21 carrying a toner image thereon, a charging device 22, a developing device 23, and a primary transfer device 24. The surface of the photoconductor drum 21 is charged by the charging device 22, and the charged surface of the photoconductor drum 21 is exposure-scanned by the exposure device 14. This allows an electrostatic latent image to be formed on the surface of the photoconductor drum 21. The developing device 23 develops the electrostatic latent image with the toner. Subsequently, the toner image on the photoconductor drum 21 is transferred to the intermediate transfer belt 5A by the primary transfer device 24.

The intermediate transfer unit 5 includes the intermediate transfer belt 5A, a driving roller 7A, and a driven roller 7B. The intermediate transfer belt 5A carries a toner image that is formed from toner images of a plurality of (in the present embodiment, four) colors. The intermediate transfer belt 5A is supported and rotationally driven by the driving roller 7A and the driven roller 7B so as to move while its surface is in contact with surfaces of the photoconductor drums 21. When the intermediate transfer belt 5A is rotationally driven, its surface passes between the photoconductor drums 21 and the primary transfer devices 24. During that movement, the toner images of the different colors carried on the plurality of photoconductor drums 21 are transferred in sequence to the intermediate transfer belt 5A in such a way as to be overlaid with each other thereon.

The toner replenishing device 40 is provided above the intermediate transfer unit 5. The toner replenishing device 40 is configured such that four toner containers 41 for colors of black, yellow, cyan, and magenta can be attached thereto and detached therefrom. The configuration of the toner replenishing device 40 is described below.

The secondary transfer device 15 transfers the toner image from the intermediate transfer belt 5A to a print sheet conveyed from the sheet feed tray 17. The print sheet on which the toner image has been transferred is conveyed by a conveyance portion (not shown) to the fixing device 16. The fixing device 16 includes a heating roller 16A and a pressure roller 16B. The fixing device 16 conveys the print sheet on which the toner image has been transferred, while applying heat and pressure thereto. This allows the toner image to be fused and fixed to the print sheet. The print sheet to which the toner image has been fixed is further conveyed to the downstream side, and discharged to and held by the sheet discharge tray 18 that is disposed above the intermediate transfer unit 5.

The belt cleaning device 6 collects waste toner, namely toner that has remained on the surface of the intermediate transfer belt 5A, and conveys the collected waste toner to the waste toner collecting device 80. The belt cleaning device 6 is disposed at the front side of the intermediate transfer unit 5. The belt cleaning device 6 includes a cleaning roller 25 that is the cleaning member, a screw member 26, and a toner box 27. The cleaning roller 25 is disposed to face the driven roller 7B, and its surface is in contact with the intermediate transfer belt 5A. The length of the cleaning roller 25 in the front-rear direction D2 is approximately the same as that of the intermediate transfer belt 5A. The cleaning roller 25 is rotatably supported in the toner box 27. The cleaning roller 25 is rotated when a rotational driving force is input to the shaft of the cleaning roller 25.

The cleaning roller 25 is rotated while it is in contact with the intermediate transfer belt 5A, thereby removing toner that has remained on the surface of the intermediate transfer belt 5A after the transfer by the secondary transfer device 15. Hereinafter, the toner that has been removed by the cleaning roller 25 is referred to as "waste toner". The waste toner is taken into the toner box 27 by the action of gravity or by the rotation of the cleaning roller 25, and collected therein. The waste toner collected in the toner box 27 is conveyed by the screw member 26. A discharge port (not shown) is formed on the bottom of the toner box 27 on the rear end side. The waste toner is conveyed in the toner box 27 toward the discharge port as the screw member 26 is rotated.

The waste toner collecting device 80 is provided below the toner box 27. The waste toner collecting device 80 is configured to store the waste toner container 81 that is attached thereto in a detachable manner. When the waste toner is discharged from the discharge port of the belt cleaning device 6, the waste toner is reserved in the waste toner container 81 attached to the waste toner collecting device 80. That is, the toner that has remained on the surface of the intermediate transfer belt 5A is removed by the belt cleaning device 6 and then stored in the waste toner container 81 as the waste toner. In the present embodiment, an empty toner container 41 that was used in the toner replenishing device 40 can be used as the waste toner container 81 as well. The waste toner collecting device 80 is described below.

[Toner Replenishing Device]

Figure 2:
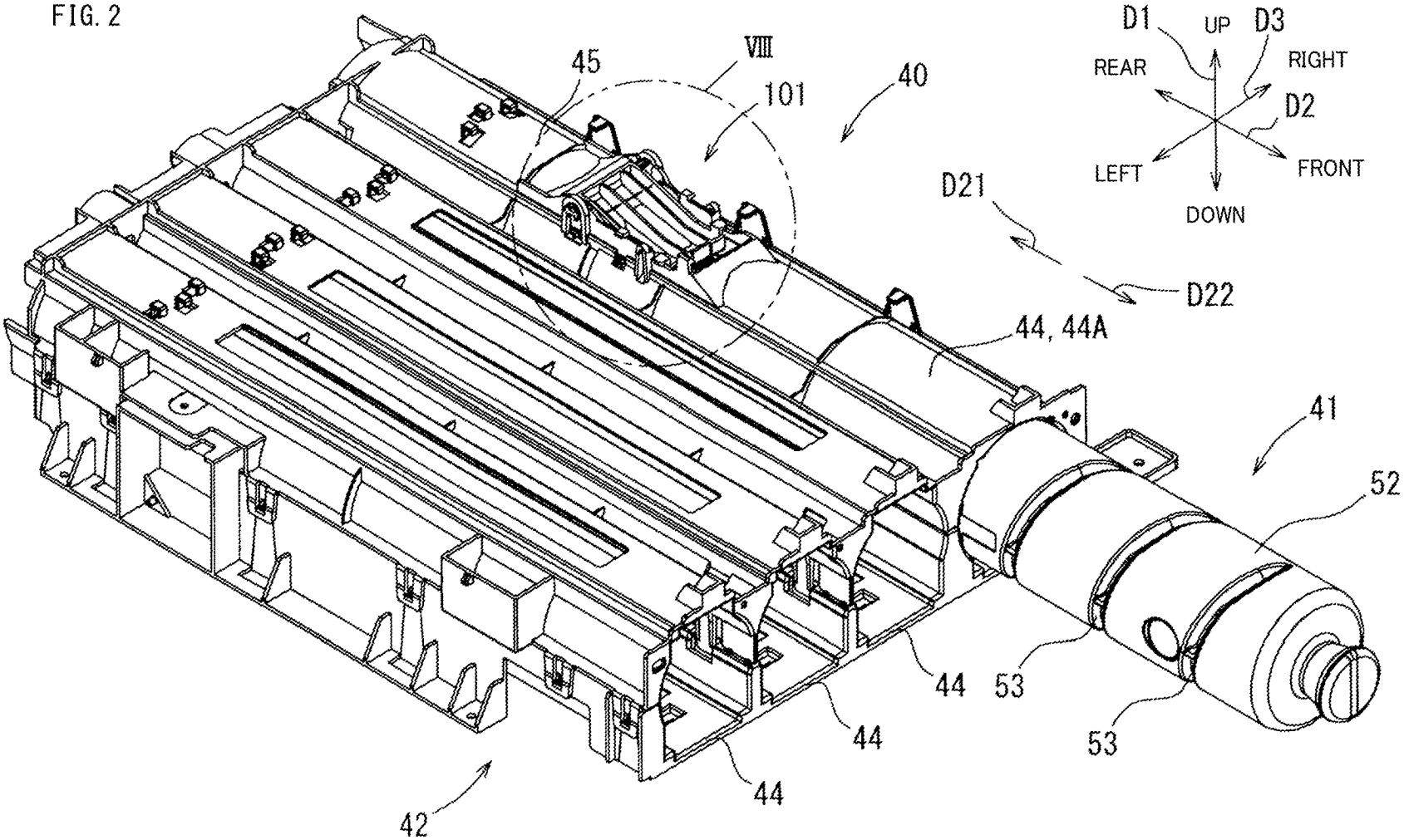
FIG. 2 is a perspective view of a toner replenishing device included in the image forming apparatus.

In the following, the toner replenishing device 40 is described with reference to FIG. 2 to FIG. 11C. As shown in FIG. 2, the toner replenishing device 40 includes toner containers 41 and a container attachment portion 42 to which the toner containers 41 are attached. It is noted that in these drawings, based on the attachment attitude where the toner replenishing device 40 is attached to the housing 11, the vertical direction is defined as the up-down direction D1, the attachment/detachment (insertion/removal) direction of the toner containers 41 to/from the housing 11 is defined as the front-rear direction D2, and the horizontal direction viewed from the front of the toner replenishing device 40 is defined as the left-right direction D3.

The toner containers 41 store toner that is to be replenished to the developing device 23. In the present embodiment, four toner containers 41 corresponding to the colors of black, yellow, cyan and magenta are provided in the toner replenishing device 40. It is noted that the toner container 41 for black has a larger external diameter than the toner containers 41 for the other colors, but except for this, all the toner containers 41 have the same configuration. In the following description, the toner container 41 refers to the toner container 41 for black unless otherwise mentioned.

The toner container 41 is elongated in the front-rear direction D2. The inside of the toner container 41 is a storage space for storing toner. The toner container 41 includes a container main body 52, a drive transmission portion 55, and a cover member 56. The container main body 52 is cylindrical, wherein an opening portion 51 (see FIG. 7) through which toner can flow in and out is formed at one of opposite ends thereof (a rear side), and the other end (a front side) is closed. The rear-end portion of the container main body 52 is formed in a tapered shape, and the opening portion 51 is formed at the rear end thereof. The opening portion 51 is circular in a cross section. The inside of the container main body 52 is a storage space for storing toner. Toner is stored in the container main body 52. The container main body 52 is made of, for example, a synthetic resin such as polyethylene terephthalate (PET resin).

Figure 3:
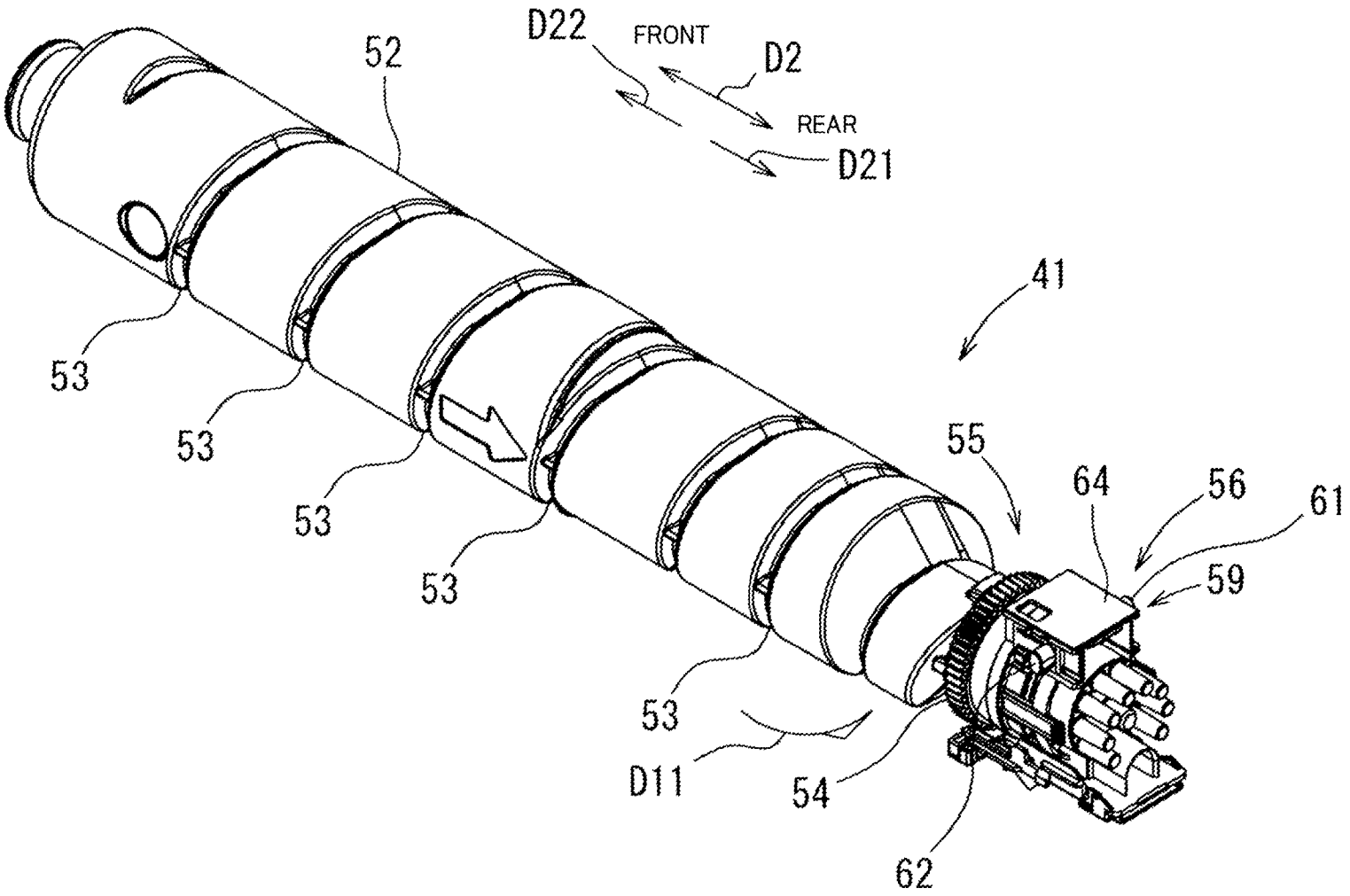
FIG. 3 is a perspective view of a toner container included in the image forming apparatus.
Figure 7:
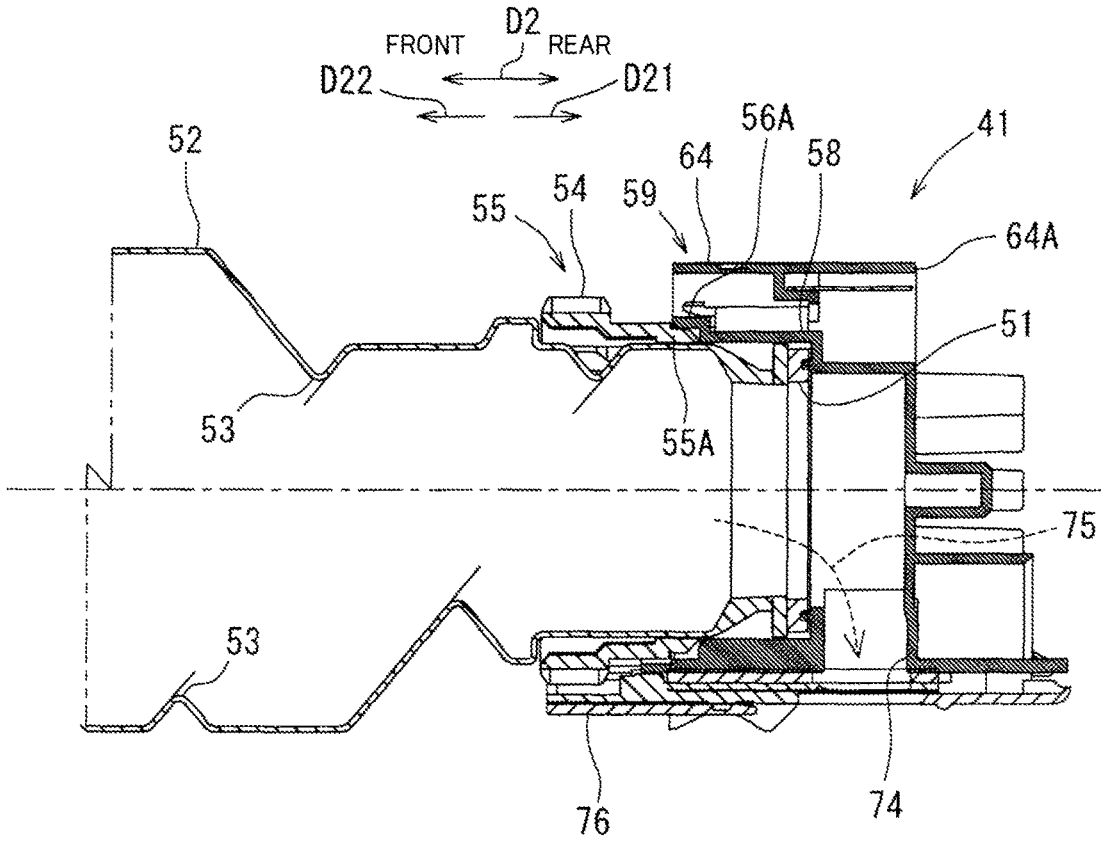
FIG. 7 is a cross section of the cover member of the toner container.

The container main body 52 includes an angled rib 53 that is formed in a spiral shape on the inner surface of the container main body 52 (see FIG. 3, FIG. 7). The angled rib 53 projects from the inner surface of the container main body 52 toward the center of the container main body 52. The angled rib 53 has a role of conveying the toner in the container main body 52 toward the opening portion 51 (see FIG. 7).

Figure 4:
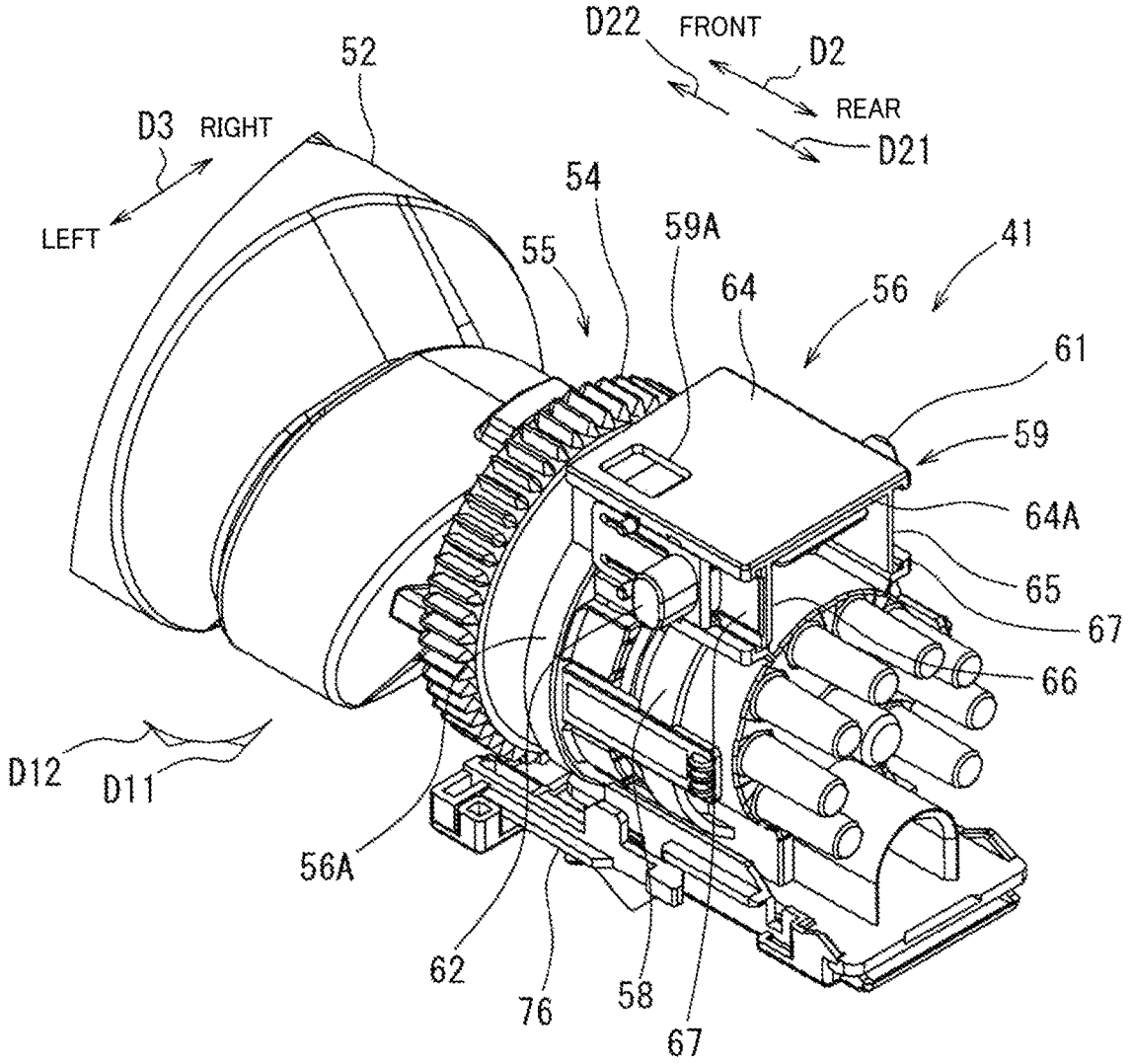
FIG. 4 is an enlarged perspective view of a cover member of the toner container.

As shown in FIG. 4, the drive transmission portion 55 is attached to the opening portion 51 side of the container main body 52. The drive transmission portion 55 is fixed to the container main body 52. The drive transmission portion 55 is an annular member with a gear 54 formed on its circumferential surface. Upon receiving a rotational driving force from a drive source such as a motor, the drive transmission portion 55 transmits the rotational driving force to the toner container 41.

In the container main body 52, the cover member 56 is provided more on the rear side than the drive transmission portion 55. The cover member 56 is provided so as to cover the opening portion 51. The cover member 56 includes a storage frame 58 of a cylindrical shape in which the opening portion 51 (see FIG. 7) is inserted. As shown in FIG. 7, the opening portion 51 is inserted in the storage frame 58, thus the opening portion 51 is covered. The storage frame 58 supports the opening portion 51 in such a manner that the opening portion 51 can pivot in the circumferential direction. As a result, in the state where the opening portion 51 is inserted in the storage frame 58, the container main body 52 can pivot in the circumferential direction. That is, the cover member 56 supports the opening portion 51 side of the container main body 52 in such a manner that the container main body 52 can pivot. A rear end portion 55A of the drive transmission portion 55 (see FIG. 7) is loosely fitted into a front end portion 56A of the cover member 56. As a result, when the rotational driving force is transmitted to the gear 54 in the state where the toner container 41 is attached to the container attachment portion 42, the container main body 52 is rotated by the rotational driving force, in a rotation direction indicated by the arrow D11 (see FIG. 4). That is, the toner container 41 rotates around its longitudinal direction in the state where toner can be supplied to the developing device 23. When the container main body 52 of the toner container 41 rotates in this way, the toner is pressed by the angled rib 53 and conveyed toward the opening portion 51 side (the rear side).

The cover member 56 includes a toner discharge port 74 (see FIG. 7). The toner discharge port 74 is provided to discharge the toner from the inside of the container main body 52 to the outside, and is provided in the outer circumferential wall of the cover member 56. The toner discharge port 74 is provided below the cover member 56 in FIG. 7. Specifically, the toner discharge port 74 is a rectangular through hole penetrating through the wall of the cover member 56. As shown in FIG. 7, a toner flow path 75 is formed inside the cover member 56 between the opening portion 51 and the toner discharge port 74. When the toner container 41 is attached to the container attachment portion 42 (see FIG. 2) with the toner discharge port 74 on the lower side, the toner, having moved from the opening portion 51 of the container main body 52 to the toner flow path 75, moves through the toner flow path 75 downward and reaches the toner discharge port 74. Here, when the toner discharge port 74 is opened, the toner is discharged from the toner discharge port 74 to the lower outside. This allows the toner to be replenished to the developing device 23. On the other hand, when the toner discharge port 74 is closed, the toner is not discharged, and the toner flow path 75 is filled with toner.

As shown in FIG. 7, the cover member 56 includes a slide-type opening/closing portion 76. The opening/closing portion 76 is a plate-like member, and is supported by the cover member 56 in such a way as to be slidable in the longitudinal direction of the container main body 52 (the front-rear direction D2). The opening/closing portion 76 opens or closes the toner discharge port 74 depending on the position of the toner container 41 with respect to the container attachment portion 42. When the toner container 41 is attached to the container attachment portion 42, the opening/closing portion 76 opens the toner discharge port 74. Specifically, when the toner container 41 is attached to the container attachment portion 42, the opening/closing portion 76 receives, from the container attachment portion 42, a pressing force that is generated by the attachment operation, and is moved to a position (opening position) where the opening/closing portion 76 opens the toner discharge port 74. FIG. 7 shows a state where the opening/closing portion 76 has moved to the front side and opened the toner discharge port 74. When the toner container 41 is removed from the container attachment portion 42, the opening/closing portion 76 is moved rearward by the removal operation, from the opening position to a position (closing position) where the opening/closing portion 76 closes the toner discharge port 74. It is noted that the container attachment portion 42 includes a biasing member (not shown), and the movement of the opening/closing portion 76 from the opening position to the closing position is realized as the biasing member causes the opening/closing portion 76 to move relatively rearward in response to the removal operation of the toner container 41.

The cover member 56 includes a support frame 59 (an example of the support portion of the present invention). The support frame 59 is disposed on an opposite side to the toner discharge port 74 (on the upper side in FIG. 7) in the cover member 56. The support frame 59 is integrally formed with the cover member 56. As shown in FIG. 4, the support frame 59 includes a rectangular upper plate 64 and a pair of side plates 65 and 66 (an example of the pair of support surfaces of the present invention). The side plates 65 and 66 are located away from each other in the left-right direction D3, and are arranged to face each other as a pair. The side plates 65 and 66 extend downward from two ends of the upper plate 64 that are opposite in the left-right direction D3, and the lower ends of the side plates 65 and 66 are connected to the outer circumferential surface of the storage frame 58. A rear end portion 64A of the upper plate 64 is configured to abut on a first abutting portion 106 that is included in a first actuator 101 (an example of the first actuating portion of the present invention) that is described below with reference to FIG. 8.

Figure 13:
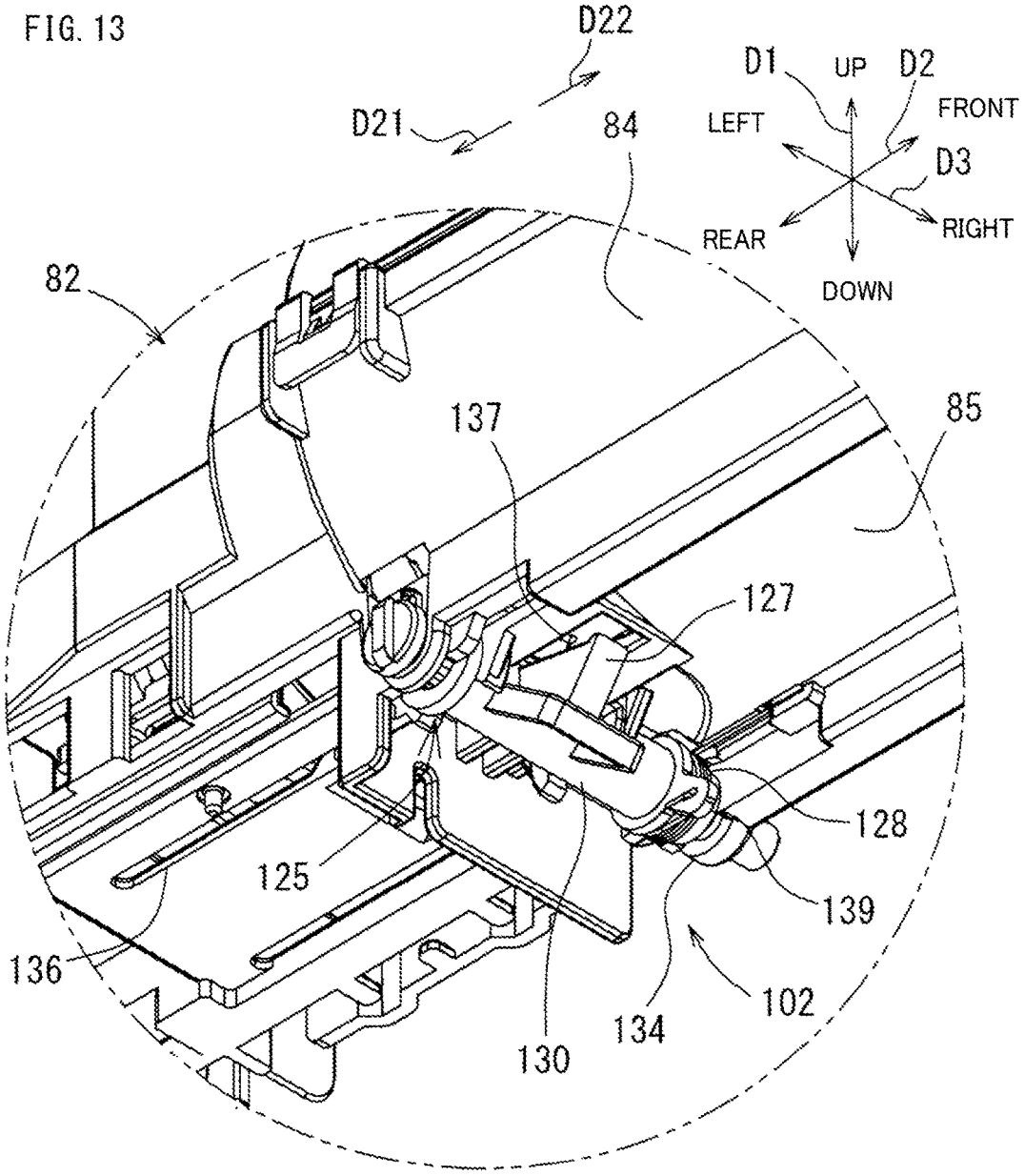
FIG. 13 is an enlarged perspective view of a second actuator included in the waste toner collecting device in a section XIII of FIG. 12.
Figure 14A:
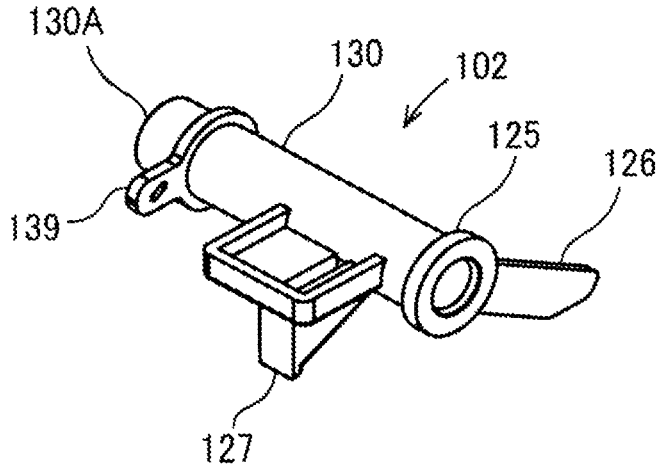
FIG. 14A, FIG. 14B, and FIG. 14C are diagrams showing a configuration of the second actuator.
Figure 14B:
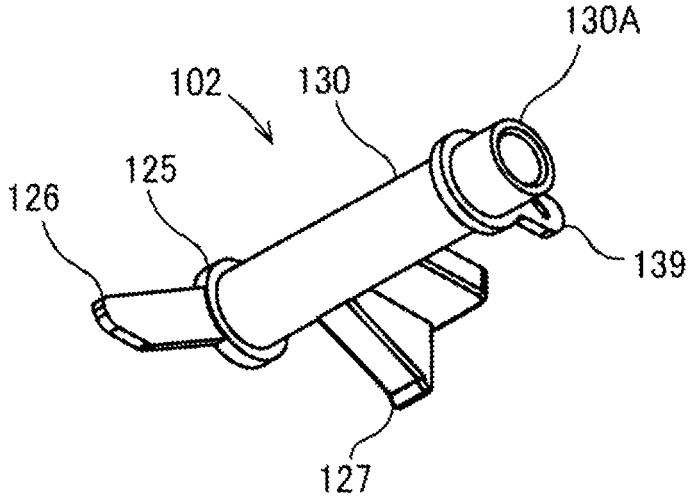
Figure 14C:
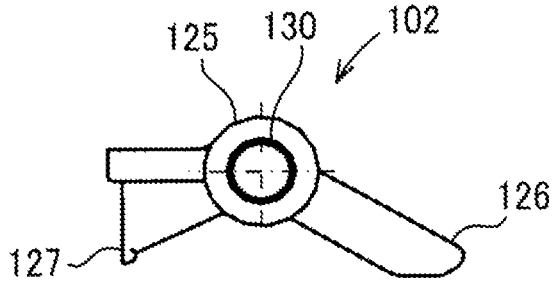

The support frame 59 includes an opening 59A (an example of the restriction portion of the present invention) between the side plate 65 and the side plate 66. The opening 59A is a through hole formed in the upper plate 64. The opening 59A is a facing surface that faces a lower wall portion 85 of the waste toner collecting device 80 when the toner container 41 is inserted in the waste toner collecting device 80 along an attachment direction D21 with the upper plate 64 on the lower side. When the toner container 41 is inserted in this state, a second actuator 102 (an example of the third actuating portion of the present invention) is engaged with the opening 59A, thereby the insertion of the toner container 41 is restricted (prohibited), wherein the second actuator 102 is described below with reference to FIG. 13.

The toner container 41 includes a first protruding portion 61 (an example of the first lever of the present invention) and a second protruding portion 62 (an example of the second lever of the present invention). The first protruding portion 61 and the second protruding portion 62 are provided on the cover member 56. Specifically, the first protruding portion 61 and the second protruding portion 62 are provided on the support frame 59 of the cover member 56. The first protruding portion 61 is supported by the side plate 65 that is disposed on the left side and protrudes leftward from the side plate 65. The second protruding portion 62 is supported by the side plate 66 that is disposed on the right side and protrudes rightward from the side plate 66.

Figure 5:
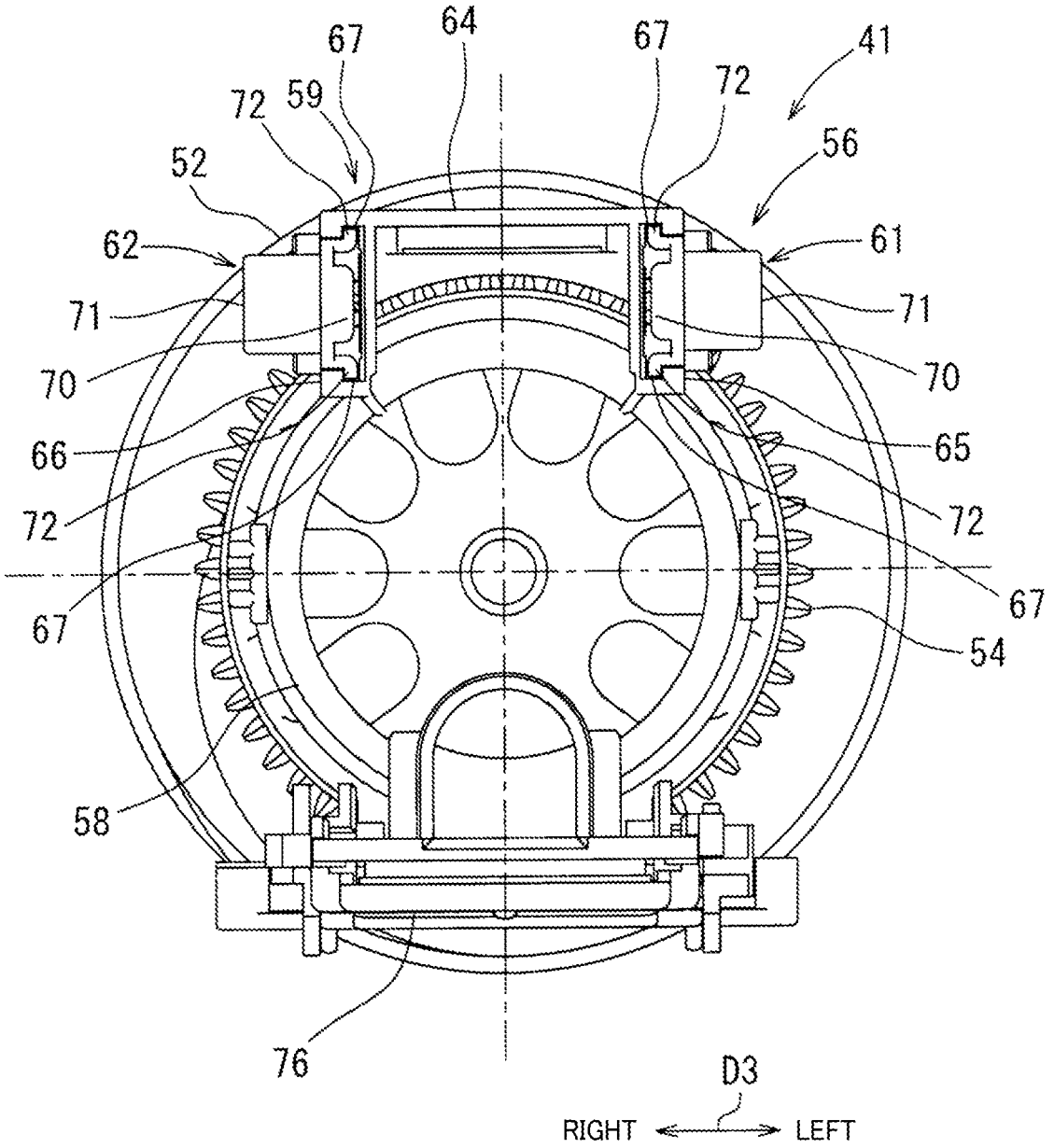
FIG. 5 is a diagram showing the cover member of the toner container.

A pair of guide grooves 67 extending in the front-rear direction D2 are formed in each of the side plates 65 and 66 (see FIG. 5). The guide grooves 67, in each pair, are located away from each other in the up-down direction D1. Each of the first protruding portion 61 and the second protruding portion 62 is attached in such a way as to be slidable (movable) in a corresponding guide groove 67. This allows the first protruding portion 61 to move in the front-rear direction D2 on the side plate 65, and the second protruding portion 62 to move in the front-rear direction D2 on the side plate 66.

Specifically, as shown in FIG. 5, the first protruding portion 61 includes a base portion 70 and a projection 71, wherein the base portion 70 is slidably supported by the guide groove 67, and the projection 71 projects in the horizontal direction from the base portion 70. The base portion 70 includes two rails 72 that are respectively provided at its upper and lower ends. The rails 72 are slidably supported by the guide groove 67. It is noted that a latch mechanism is provided in the guide groove 67 and the rails 72, wherein the latch mechanism is configured to temporarily hold the first protruding portion 61 at a first position P1 and a second position P2 that are described below with reference to FIGS. 6A-6C. As a result, when the first protruding portion 61 is moved to any of the first position P1 and the second position P2, the first protruding portion 61 is held at that position by the latch mechanism.

The support mechanism of the second protruding portion 62 has approximately the same configuration as the support mechanism of the first protruding portion 61, and the second protruding portion 62 includes a base portion 70 and a projection 71. The base portion 70 includes two rails 72 provided at the upper and lower ends thereof respectively. The rails 72 are slidably supported by the guide groove 67. It is noted that a latch mechanism is provided in the guide groove 67 and the rails 72, wherein the latch mechanism is configured to temporarily hold the second protruding portion 62 at a third position P3 and a fourth position P4. As a result, when the second protruding portion 62 is moved to any of the third position P3 and the fourth position P4, the second protruding portion 62 is held at that position by the latch mechanism.

Figure 6C:
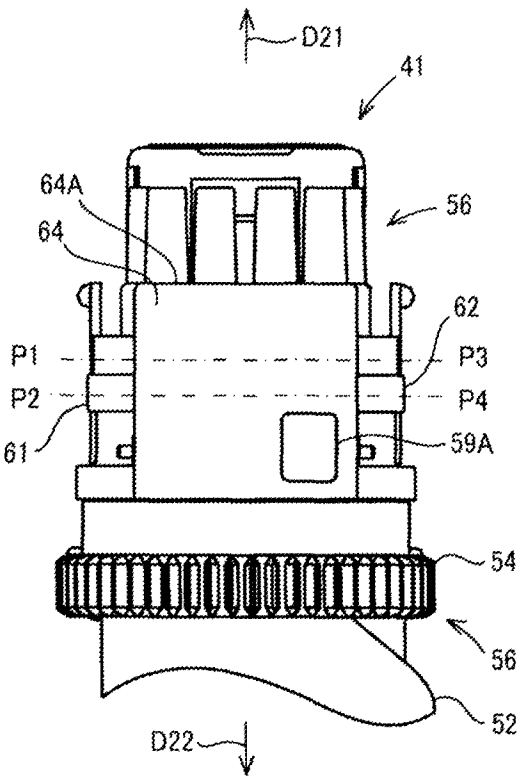
FIG. 6A, FIG. 6B, and FIG. 6C are diagrams for explaining the operation of a protruding portion of the cover member of the toner container.
Figure 6B:
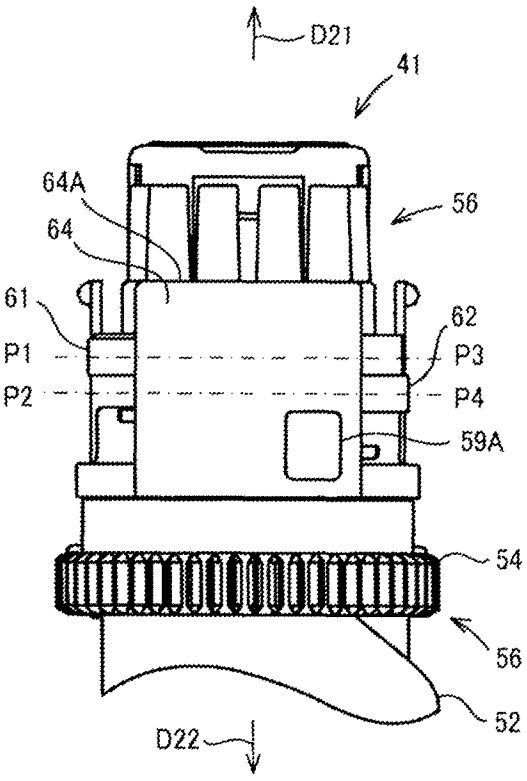
Figure 6A:
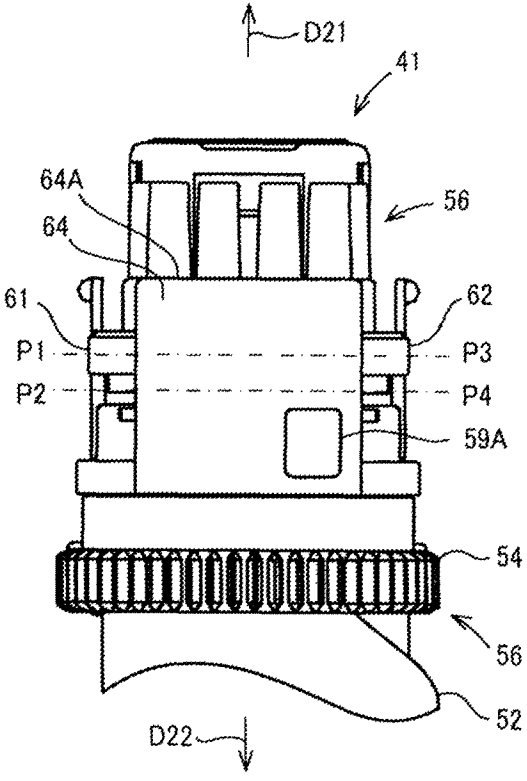

The first protruding portion 61 is slidable between a predetermined first position P1 (see FIG. 6A) and a second position P2 (see FIG. 6A). In other words, the first protruding portion 61 is configured to switch between the first position P1 and the second position P2. The second protruding portion 62 is slidable between a predetermined third position P3 (see FIG. 6A) and a fourth position P4 (see FIG. 6A). In other words, the second protruding portion 62 is configured to switch between the third position P3 and the fourth position P4. The first position P1 is a position (an initial position) at which the first protruding portion 61 is disposed initially in an unused toner container 41 in which the container main body 52 is filled with unused toner. In addition, the third position P3 is a position (an initial position) at which the second protruding portion 62 is disposed initially in an unused toner container 41. That is, in an unused toner container 41 bought by the user, the first protruding portion 61 is disposed at the first position P1, and the second protruding portion 62 is disposed at the third position P3. The second position P2 is located more on the front side than the first position P1. In other words, the second position P2 is located away from the first position P1 by a predetermined interval in a removal direction (draw-out direction) D22 in which the toner container 41 is removed from the toner replenishing device 40. The fourth position P4 is located more on the front side than the third position P3. In other words, the fourth position P4 is located away from the third position P3 by a predetermined interval in the removal direction D22. In the present embodiment, the first position P1 and the third position P3 are approximately at the same position in the front-rear direction D2. In addition, the second position P2 and the fourth position P4 are approximately at the same position in the front-rear direction D2.

As shown in FIG. 2, the container attachment portion 42 includes four storage portions 44. The storage portions 44 respectively store the toner containers 41 of predetermined colors. The rightmost storage portion 44A (an example of the first storage portion of the present invention) stores the toner container 41 for black. FIG. 2 shows a state where a part of the rear-side portion of the toner container 41 for black is inserted in the storage portion 44.

Meanwhile, there is known a conventional image forming apparatus in which a used, empty toner container (hereinafter referred to as "empty container") 41 can be used as a waste toner container. However, according to the conventional configuration, a part of the empty container 41 is deformed or cut. As a result, once an empty container 41 is used as a waste toner container, the container 41 cannot be used for the other purposes. In addition, there is a possibility that a fragment broken off from an empty container 41 may remain in the waste toner collecting device 80 and obstruct the attachment or detachment of the waste toner container. In view of these, in the image forming apparatus 10 of the present embodiment, the toner replenishing device 40 includes the first actuator 101 (an example of the first actuating portion of the present invention), and the waste toner collecting device 80 includes the second actuator 102 (an example of the third actuating portion of the present invention). With this configuration, a waste toner container can be smoothly inserted to and removed from the waste toner collecting device 80, and a same toner container 41 can be used both as a toner container for replenishing toner and as a toner container for collecting waste toner, while the toner container 41 having collected the waste toner is prevented from being attached to the toner replenishing device 40, thereby preventing the waste toner from being reused.

The storage portion 44A includes the first actuator 101. The first actuator 101 is configured to, when a toner container 41 is attempted to be inserted in the storage portion 44A, permit or restrict the attachment of the toner container 41 to the storage portion 44A, depending on the position of the first protruding portion 61.

Figure 8:
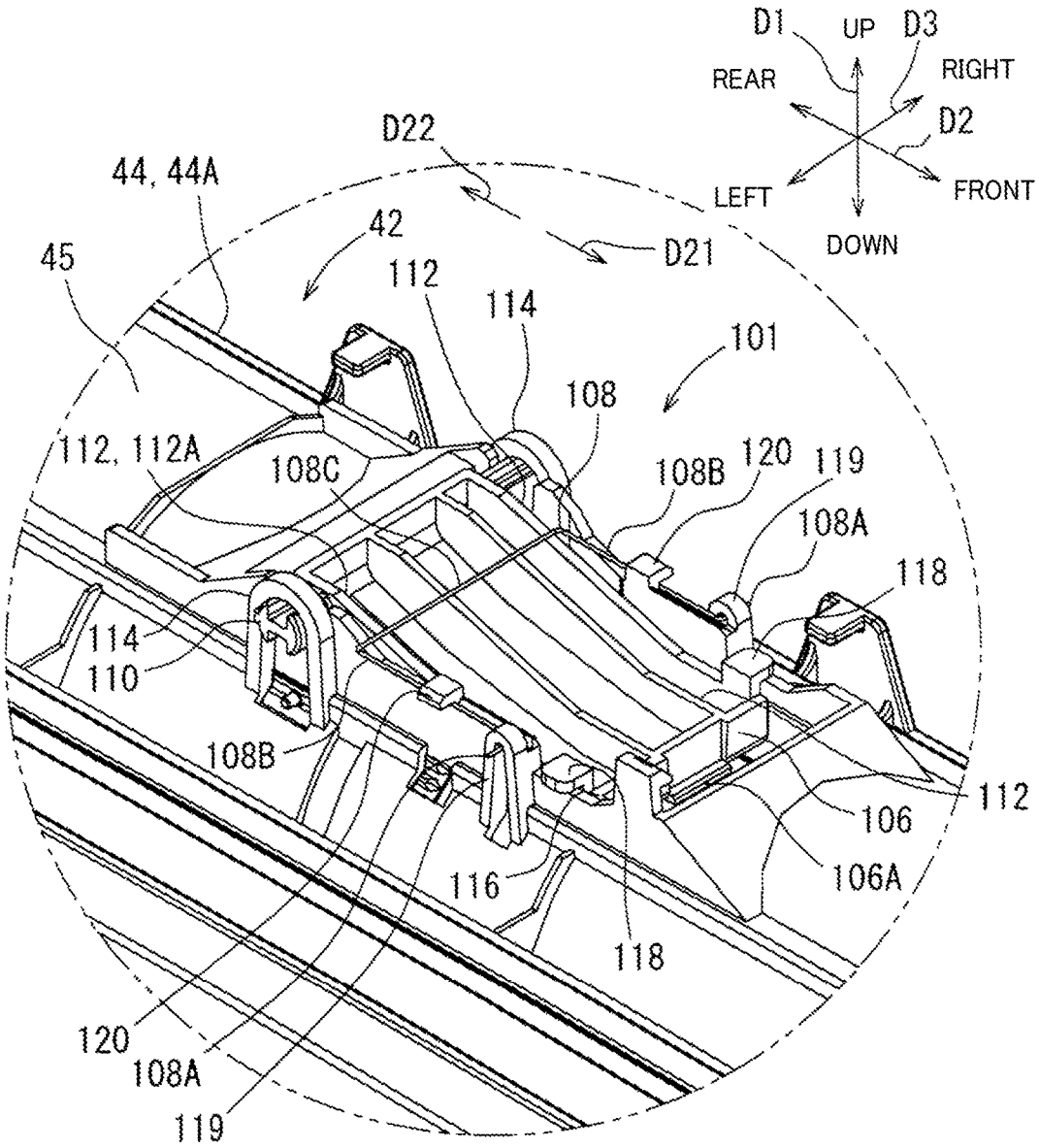
FIG. 8 is an enlarged perspective view of a first actuator included in a toner replenishing device in a section VIII of FIG. 2.

As shown in FIG. 8, the first actuator 101 is mounted on an upper wall portion 45 (an example of the upper wall of the present invention) of the storage portion 44A. When the first protruding portion 61 is disposed at the first position P1, the first actuator 101 permits the attachment of the toner container 41 to the storage portion 44A. In addition, the first actuator 101 acts on the toner container 41 in the state where the first protruding portion 61 is disposed at the second position P2, and restricts (prohibits) the attachment of the toner container 41 to the storage portion 44A (see FIG. 10B). Specifically, the first actuator 101 includes a first movable portion 105, a first abutting portion 106, a second abutting portion 107 (see FIG. 9A), and a first biasing member 108.

Figure 9A:
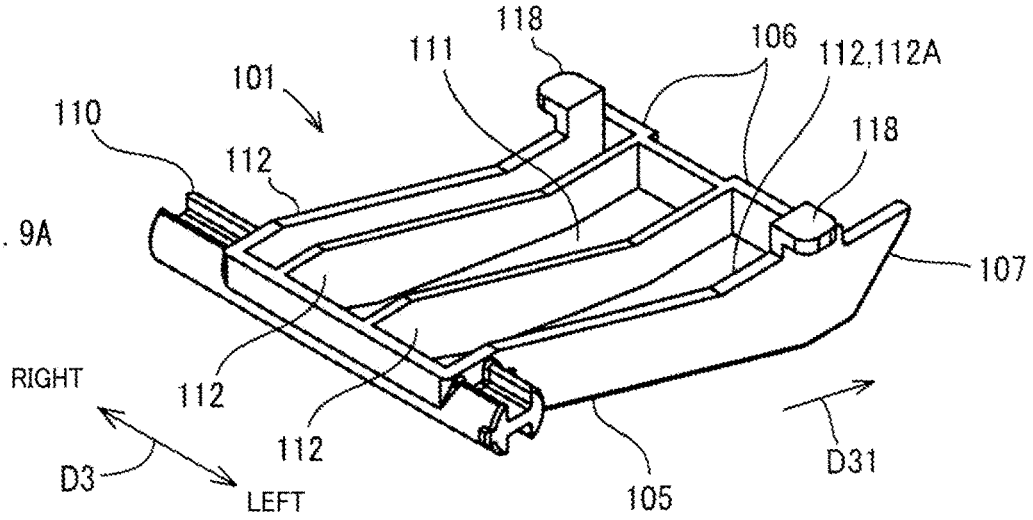
FIG. 9A, FIG. 9B, and FIG. 9C are diagrams showing a configuration of the first actuator.
Figure 9B:
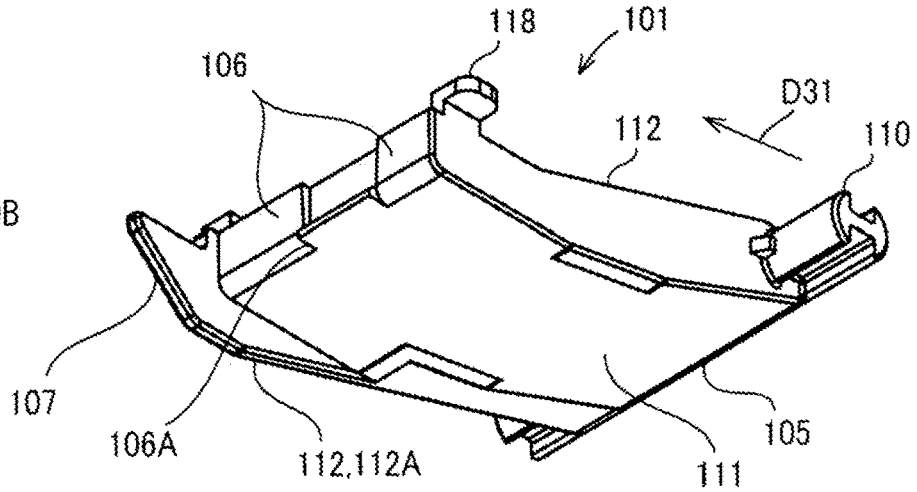
Figure 9C:
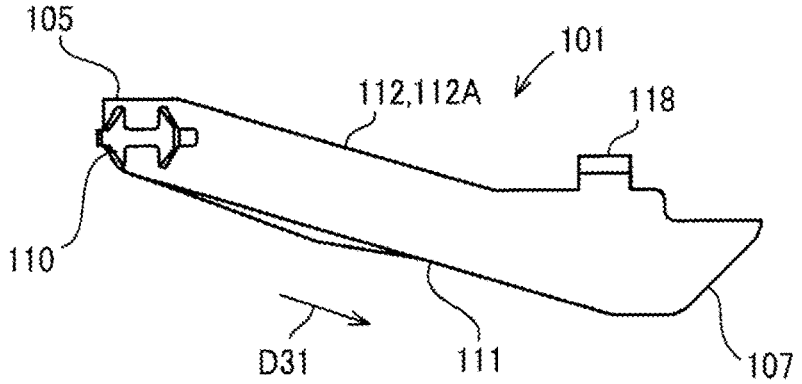

As shown in FIG. 9A to FIG. 9C, the first movable portion 105 includes a pivotal shaft 110 and a base portion 111 that extends from the pivotal shaft 110 in an extension direction D31 that is perpendicular to the pivotal shaft 110. The base portion 111 is an approximately rectangular plate member, and a plurality of ribs 112 are formed on one surface (in FIG. 9A, an upper surface) of the base portion 111, the ribs 112 extending in the extension direction D31. The pivotal shaft 110 is pivotably supported by the upper wall portion 45. Specifically, a pair of bearing portions 114 that are located away from each other in the left-right direction D3 are provided on the upper wall portion 45, and the pivotal shaft 110 is pivotably supported by the bearing portions 114.

In the upper wall portion 45, an opening 116 is formed more on the front side than the bearing portions 114, the opening 116 communicating with the inside of the storage portion 44A. As shown in FIG. 8, in the first movable portion 105, the base portion 111 is inserted in the opening 116 in the state where the pivotal shaft 110 is supported by the bearing portions 114. A pair of stoppers 118 are provided on an extension end of the base portion 111, the stoppers 118 extending in the same direction as an axis direction of the pivotal shaft 110. As a result, when the first movable portion 105 is inserted in the opening 116 of the upper wall portion 45, the first movable portion 105 is held in an entering attitude (the attitude shown in FIG. 8) where the stoppers 118 are hooked to the rim of the opening 116, and a part of the first movable portion 105 enters the opening 116. In addition, when the first movable portion 105 in the entering attitude receives an upward pressing force from the inside of the storage portion 44A, the first movable portion 105 is displaced to a retreating attitude where it has retreated upward from the opening 116. That is, the first actuator 101 is configured to be able to enter from the upper wall portion 45 of the storage portion 44A to the inside of the storage portion 44A and retreat therefrom.

The first biasing member 108 biases the first movable portion 105 from the upper wall portion 45 toward the inside of the storage portion 44A. The first biasing member 108 is attached to the upper wall portion 45. As shown in FIG. 8, the first biasing member 108 is a wire-like steel bent in a rectangular shape. Two opposite ends of the first biasing member 108 constitute shafts 108A, and are pivotably attached to the upper wall portion 45. Specifically, a pair of attachment portions 119 are provided in the upper wall portion 45 more on the front side than the bearing portions 114 on the rim of the opening 116. The shafts 108A are inserted in and supported by the shaft holes of the attachment portions 119. The first biasing member 108 includes arm portions 108B that respectively extend from the shafts 108A, and a straight connection portion 108C that connects the arm portions 108B. A rectangular portion is formed by the arm portions 108B and the connection portion 108C.

A pair of locking pieces 120 are provided on the rim of the opening 116 between the bearing portions 114 and the attachment portions 119, the locking pieces 120 being configured to engage with the arm portions 108B of the first biasing member 108. The locking pieces 120 are projecting outward from the rim of the opening 116, and the first biasing member 108 is engaged with the lower surfaces of the locking pieces 120. In the state where the shafts 108A are supported by the attachment portions 119, and the arm portions 108B are engaged with the locking pieces 120, the connection portion 108C of the first biasing member 108 elastically biases the ribs 112 of the first movable portion 105 downward. That is, the first biasing member 108 biases the first movable portion 105 toward the entering attitude. When the first movable portion 105 in the entering attitude receives an upward pressing force from the inside of the storage portion 44A, the first movable portion 105 is displaced from the entering attitude to the retreating attitude against the biasing force of the first biasing member 108.

It is noted that the first biasing member 108 is not limited to a wire-like member as far as it can elastically bias the first movable portion 105 from the upper wall portion 45 toward the inside of the storage portion 44A. Springs and elastic members of various shapes and materials, such as a torsion coil spring and a plate spring, are applicable to the first biasing member 108.

As shown in FIG. 9B, the first abutting portion 106 is provided in the first movable portion 105. The first abutting portion 106 is provided at a forward end of the base portion 111 in the extension direction D31. The first abutting portion 106 is configured to abut on the rear end portion 64A of the upper plate 64 of the support frame 59 of the toner container 41, when the first movable portion 105 is in the entering attitude. The first abutting portion 106 includes a locking piece 106A that projects in the extension direction D31 from the rear surface of the first movable portion 105. When the first abutting portion 106 abuts on the rear end portion 64A, the locking piece 106A enters the rear side of the upper plate 64. This allows the locking piece 106A to engage with the rear end portion 64A of the upper plate 64, thereby preventing the first movable portion 105 from being displaced upward (toward the retreating attitude).

The second abutting portion 107 is provided in the first movable portion 105. The second abutting portion 107 is provided on a rib 112A that is a rib 112 at the leftmost position among the four ribs 112 provided on the base portion 111. Specifically, the second abutting portion 107 is provided at a forward end of the rib 112A in the extension direction D31, extending from the first abutting portion 106 in the extension direction D31. The second abutting portion 107 is an inclined portion having an inclined surface that is inclined from the rear surface of the first movable portion 105 toward the projection end. The second abutting portion 107 is configured to abut on the first protruding portion 61 of the support frame 59 of the toner container 41 when the first movable portion 105 is in the entering attitude.

According to the present embodiment, since the first actuator 101 having the above-described configuration is provided in the storage portion 44A, when the toner container 41 is inserted in the storage portion 44A, either the first abutting portion 106 or the second abutting portion 107 abuts on the rear end portion 64A or the first protruding portion 61. Specifically, as shown in FIG. 10A, when the toner container 41 is inserted in the storage portion 44A in the state where the first protruding portion 61 is at the first position P1, the second abutting portion 107 abuts on the first protruding portion 61 before the first abutting portion 106 abuts. In this case, the first abutting portion 106 does not abut on the rear end portion 64A. At this time, the second abutting portion 107 receives an upward pressing force from the first protruding portion 61, and the first actuator 101 is displaced upward toward the retreating attitude. This allows the toner container 41 to be inserted in the storage portion 44A without interruption by the first abutting portion 106, to a predetermined attachment position in the storage portion 44A.

Figure 10B:
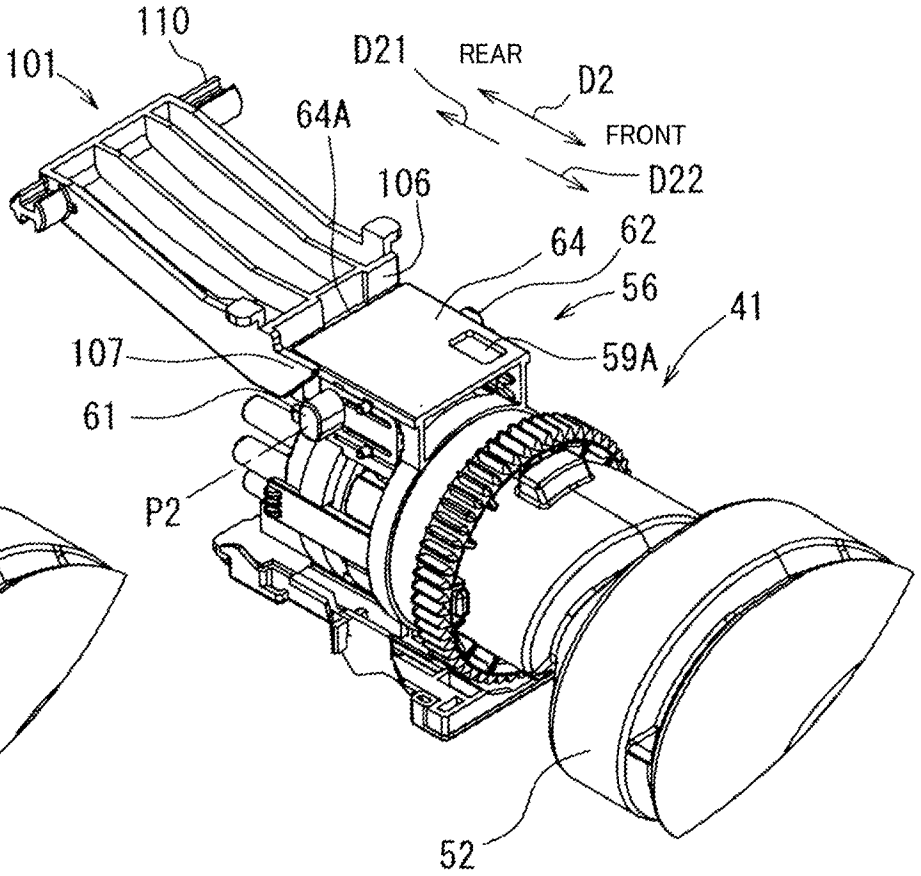
FIG. 10A and FIG. 10B are diagrams showing an operational relationship between the first actuator and a first protruding portion of the cover member.
Figure 10A:
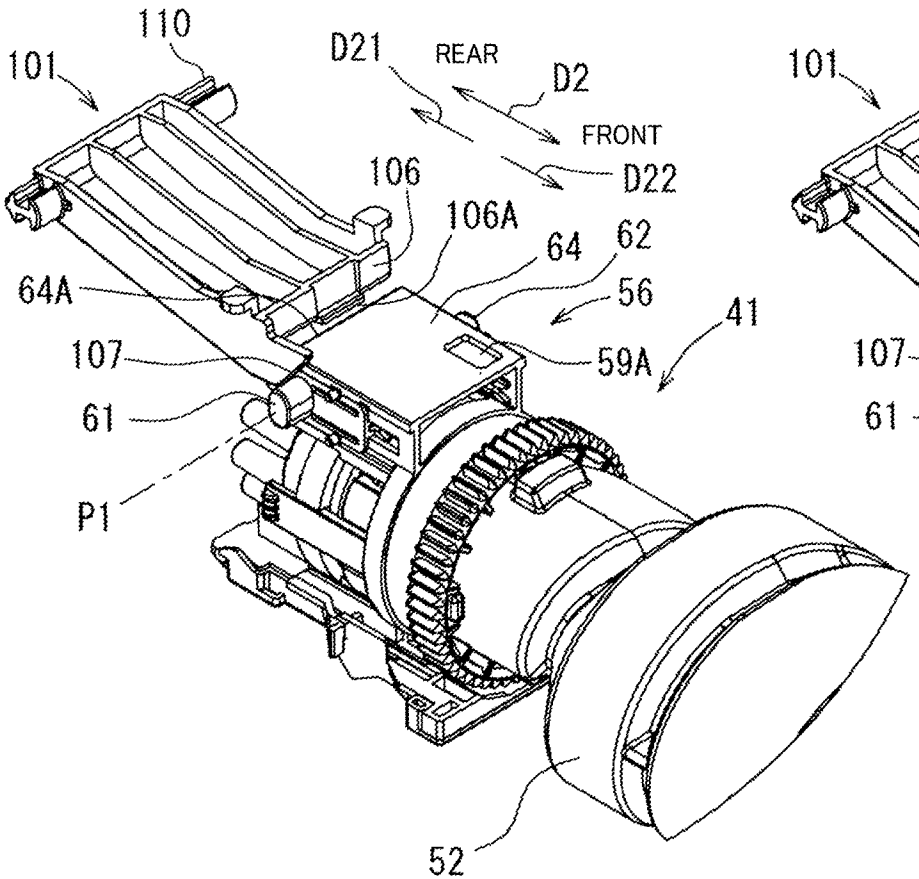

In addition, as shown in FIG. 10B, when the toner container 41 is inserted in the storage portion 44A in the state where the first protruding portion 61 is at the second position P2, the first abutting portion 106 abuts on the rear end portion 64A before the second abutting portion 107 abuts. In this case, the second abutting portion 107 does not abut on the first protruding portion 61. At this time, the first actuator 101 maintains the entering attitude since the first abutting portion 106 abuts on the rear end portion 64A. This restricts (prohibits) the toner container 41 from being inserted further in the storage portion 44A, and the toner container 41 cannot be inserted to the attachment position of the storage portion 44A. It is noted that, when the first abutting portion 106 abuts on the rear end portion 64A, the locking piece 106A enters the rear side of the upper plate 64 and engages with the rear end portion 64A. As a result, even if an upward pressing force is given to the first movable portion 105 due to the shock that is generated when the first abutting portion 106 abuts on the rear end portion 64A by the insertion of the toner container 41, the locking piece 106A allows the first movable portion 105 to maintain the entering attitude.

Figures 11A, 11B, 11C:
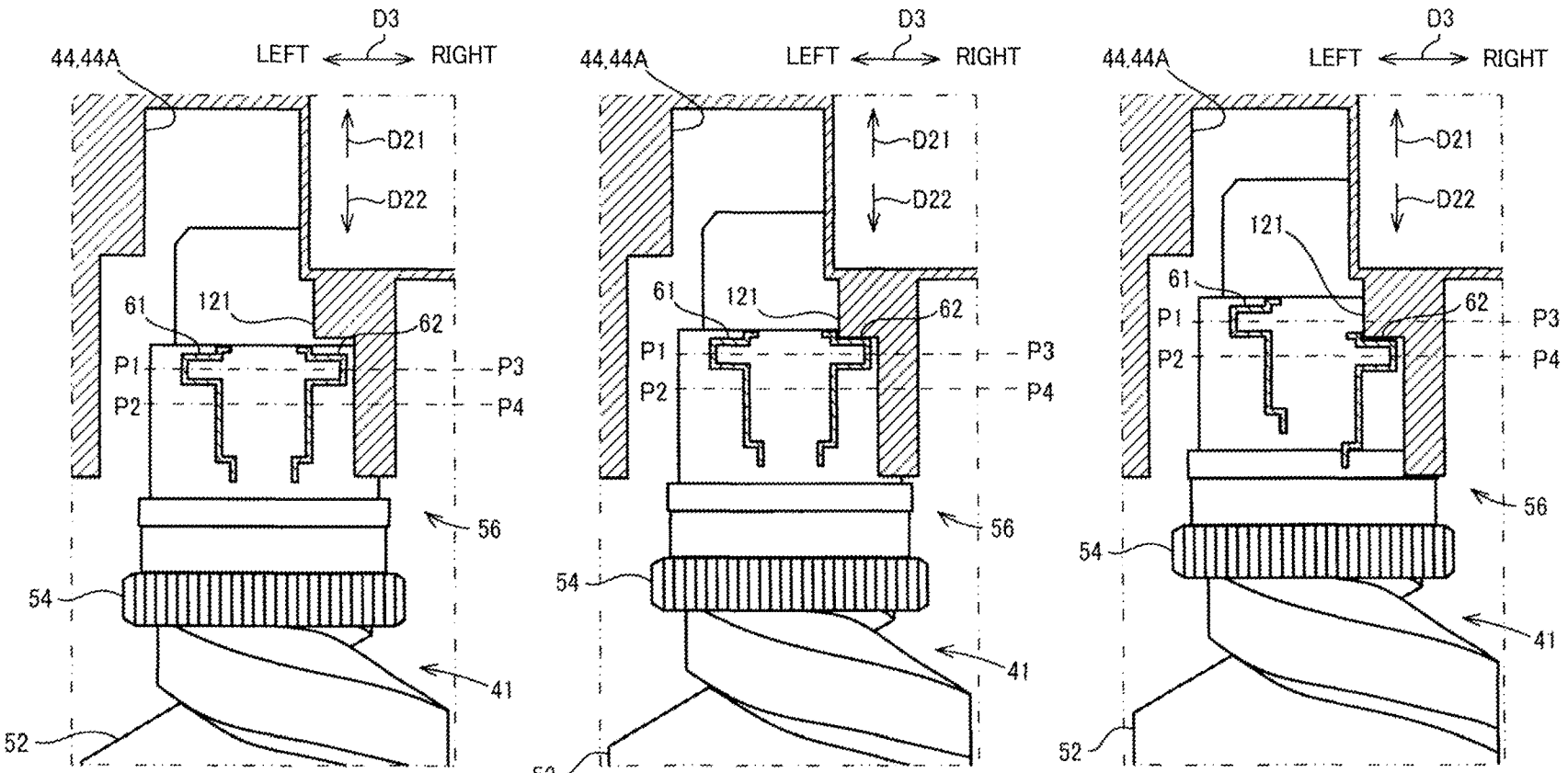
FIG. 11A, FIG. 11B, and FIG. 11C are diagrams showing an operational relationship between a second protruding portion of the cover member and a first pressing portion.

Here, as shown in FIG. 11A to FIG. 11C, the storage portion 44A includes a first pressing portion 121 (an example of the second actuating portion of the present invention). The first pressing portion 121 is integrally formed with the inner wall of the storage portion 44A. During a process in which the toner container 41 is attached to the storage portion 44A, the first pressing portion 121 acts on and presses the second protruding portion 62 frontward (see FIG. 11A, FIG. 11B). This allows the second protruding portion 62 to move from the third position P3 to the fourth position P4 (see FIG. 11C). That is, the second protruding portion 62 is switched from the third position P3 to the fourth position P4. According to the present embodiment, when the toner container 41 attached to the storage portion 44A becomes empty, the empty toner container 41 (hereinafter referred to as an "empty container 41") can be used in the waste toner collecting device 80. On the other hand, to prevent a new, unused toner container 41 from being erroneously attached to the waste toner collecting device 80, it is configured so that a toner container 41 can be attached to the waste toner collecting device 80 only when it has become empty. A detailed description of that configuration is provided below, but it is configured so that the toner container 41 cannot be attached to the waste toner collecting device 80 when the second protruding portion 62 is disposed at the third position P3, and the toner container 41 can be attached to the waste toner collecting device 80 when the second protruding portion 62 is disposed at the fourth position P4.

[Waste Toner Collecting Device]

Figure 12:
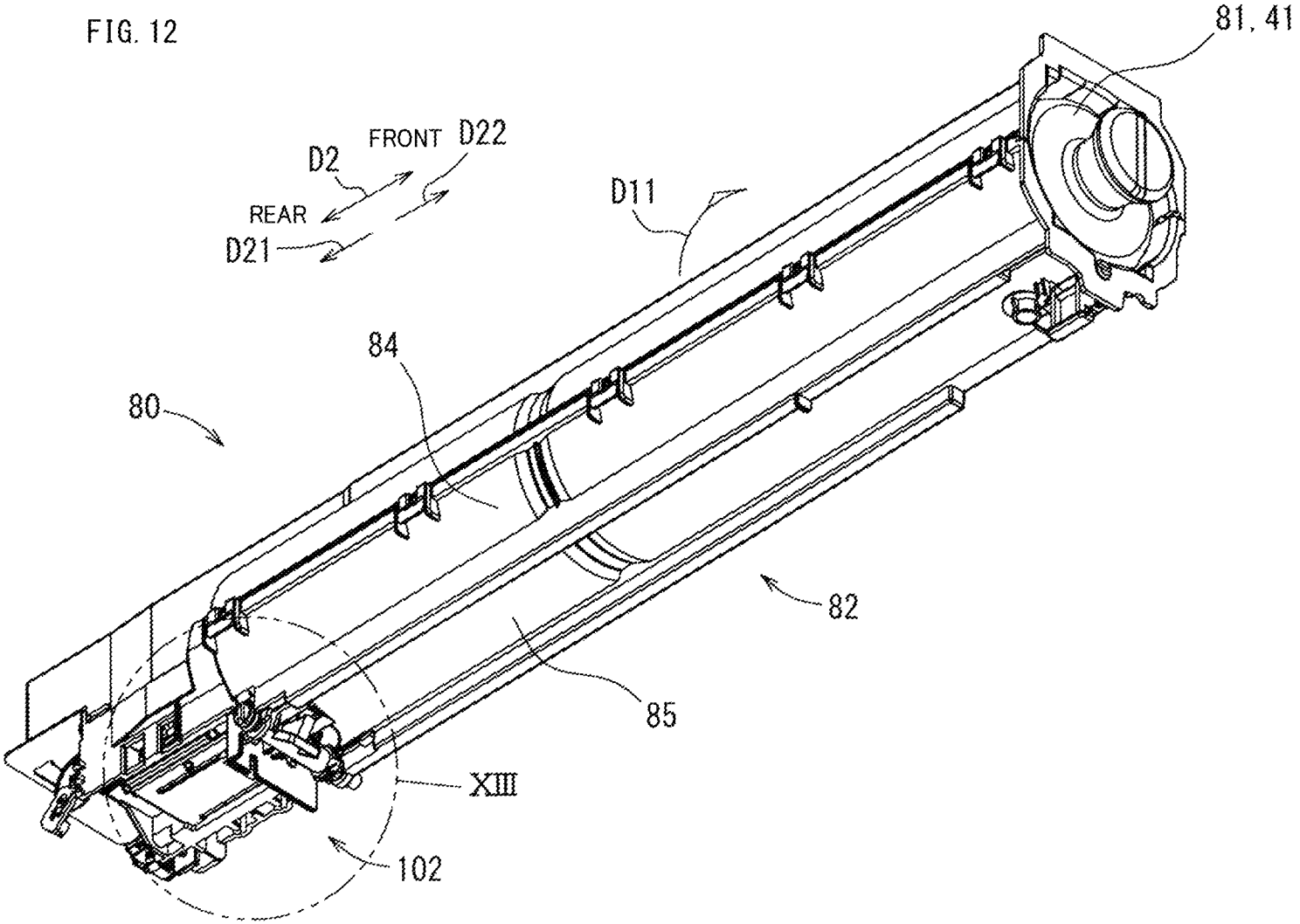
FIG. 12 is a perspective view of a waste toner collecting device included in the image forming apparatus.

In the following, the waste toner collecting device 80 is described with reference to FIG. 12 to FIG. 16C. As shown in FIG. 12, the waste toner collecting device 80 is composed of the waste toner container 81 and a container attachment portion 82 to which the waste toner container 81 is attached. Here, FIG. 12 shows a state where the waste toner container 81 is attached to the waste toner collecting device 80. It is noted that in these drawings, the up-down direction D1 is defined as the vertical direction on the basis of an attachment attitude of the waste toner collecting device 80 attached to the housing 11, the front-rear direction D2 is defined as the attachment/detachment (insertion/removal) direction of the waste toner container 81 with respect to the housing 11, and the left-right direction D3 is defined as the horizontal direction when viewed from the front of the waste toner collecting device 80.

The waste toner container 81 has the same shape as the toner container 41 that can be attached to the toner replenishing device 40. In the present embodiment, the waste toner container 81 is a used, empty toner container (empty container) 41 from which all the toner had been used in the toner replenishing device 40. Specifically, the waste toner container 81 is a toner container 41 that had been attached to the storage portion 44A, and was removed from the storage portion 44A after it had become empty and the toner therein had been consumed. As described above, a new toner container 41 is in a state (an example of the first state of the present invention) where the first protruding portion 61 is disposed at the first position P1 and the second protruding portion 62 is disposed at the third position P3. When the new toner container 41 is inserted in the storage portion 44, the first protruding portion 61 maintains to be disposed at the first position P1, and the second protruding portion 62 is moved from the third position P3 to the fourth position P4. That is, the second protruding portion 62 is switched from the third position P3 to the fourth position P4. As a result, an empty container 41 immediately after being removed from the storage portion 44A is in a state (an example of the second state of the present invention) where the first protruding portion 61 is disposed at the first position P1 and the second protruding portion 62 is disposed at the fourth position P4. A toner container 41 in this state can be attached to any of the toner replenishing device 40 or the waste toner collecting device 80. Since the waste toner container 81 has the same configuration as the toner container 41, in the following, the same reference signs are used and the description of the configuration is omitted.

The waste toner container 81 is attached to the container attachment portion 82 in the state where the toner discharge port 74 faces up. The rotational driving force from a driving source such as a motor is transmitted to the gear 54 in the state where the waste toner container 81 is attached to a predetermined attachment position in the container attachment portion 82. At this time, a rotational driving force of a second rotation direction (see the arrow D12) is transmitted to the gear 54, wherein the second rotation direction is opposite to a first rotation direction (see the arrow D11) of the toner container 41. Upon receiving the rotational driving force, the waste toner container 81 is rotated in the second rotation direction indicated by the arrow D12. That is, the waste toner container 81 is rotated in the second rotation direction (see the arrow D12) opposite to the first rotation direction D11 in the state where the waste toner container 81 is attached to the container attachment portion 82, and the waste toner flows to the toner discharge port 74. This allows the waste toner stored in the waste toner container 81 to be pressed by the angled rib 53 and conveyed away from the opening portion 51 (frontward).

The container attachment portion 82 is configured to store the waste toner container 81 that is attached thereto in a detachable manner. In the state where the waste toner container 81 is attached to the container attachment portion 82, the container attachment portion 82 is configured to guide the waste toner discharged from the belt cleaning device 6, from the toner discharge port 74 to the inside of the waste toner container 81. The waste toner container 81 is configured to be detached from the container attachment portion 82 and attached to the container attachment portion 82 as necessary. Specifically, when the waste toner container 81 is filled with the waste toner or when the amount of waste toner stored therein becomes equal to or larger than a predetermined amount (full amount), the waste toner container 81 is removed by the user. Subsequently, an empty waste toner container 81 is attached by the user.

As shown in FIG. 12, the container attachment portion 82 includes a storage portion 84 (an example of the second storage portion of the present invention). The storage portion 84 stores, as the waste toner container 81, an empty container 41 that had been attached to the storage portion 44A of the toner replenishing device 40.

The storage portion 84 includes the second actuator 102. The second actuator 102 is configured to, when a waste toner container 81 is attempted to be inserted in the storage portion 84, permit or restrict (prohibit) the attachment of the waste toner container 81 to the storage portion 84, depending on the position of the second protruding portion 62.

As shown in FIG. 12, the second actuator 102 is mounted on a lower wall portion 85 (an example of the lower wall of the present invention) of the storage portion 84. When the second protruding portion 62 is disposed at the fourth position P4, the second actuator 102 permits the attachment of the waste toner container 81 to the storage portion 84. In addition, the second actuator 102 restricts (prohibits) the attachment of the waste toner container 81 to the storage portion 84 if the second protruding portion 62 is disposed at the third position P3. In other words, when the waste toner container 81 is attempted to be attached to the storage portion 84, the second actuator 102 acts on the second protruding portion 62 disposed at the third position P3 and restricts (prohibits) the attachment of the waste toner container 81 to the storage portion 84. Specifically, the second actuator 102 includes a second movable portion 125, a first projection piece 126, a second projection piece 127, and a second biasing member 128.

As shown in FIG. 13 and FIG. 14A to FIG. 14C, the second movable portion 125 includes a pivotal shaft 130. The pivotal shaft 130 is pivotably supported by the lower wall portion 85. Specifically, a pair of bearing portions 134 that are located away from each other in the left-right direction D3 are provided on the lower wall portion 85, and the pivotal shaft 130 is pivotably supported by the bearing portions 134. In this way, the second movable portion 125 is supported by the lower wall portion 85 in such a way as to be pivotable around the pivotal shaft 130.

Two openings 136 and 137 are formed in the lower wall portion 85. The opening 136 is formed more on the rear side than the bearing portions 134, the opening 136 communicating with the inside of the storage portion 84. The opening 137 is formed more on the front side than the bearing portions 134, the opening 137 communicating with the inside of the storage portion 84.

The second movable portion 125 includes the first projection piece 126, the second projection piece 127, and the second biasing member 128. The first projection piece 126 projects outward from the pivotal shaft 130 in its radial direction. The second projection piece 127 projects outward from the pivotal shaft 130 in a radial direction thereof that is different from the projection direction of the first projection piece 126. The angle between the first projection piece 126 and the second projection piece 127 is set to be approximately 120 degrees.

In the state where the pivotal shaft 130 is supported by the bearing portions 134, the first projection piece 126 can be inserted in the storage portion 84 from the lower wall portion 85 via the opening 136. As a result, when the second movable portion 125 is pivoted around the pivotal shaft 130, the first projection piece 126 can be displaced to an entering attitude or to a retreating attitude, wherein in the entering attitude, the first projection piece 126 has entered the inside of the storage portion 84 from the opening 136, and in the retreating attitude, the first projection piece 126 has retreated from the inside of the storage portion 84. That is, the second actuator 102 is configured such that the second movable portion 125 can enter from the lower wall portion 85 of the storage portion 84 to the inside of the storage portion 84 and retreat therefrom.

In addition, when the first projection piece 126 is in a state (entering attitude) of having entered the inside of the storage portion 84 from the opening 136, the second projection piece 127 is in a state (retreating attitude) of having retreated from the opening 137 of the lower wall portion 85 to outside. Furthermore, when the first projection piece 126 retreats from the opening 136 to outside, the second projection piece 127 enters the inside of the storage portion 84 and is engaged with the opening 59A of the support frame 59.

The second biasing member 128 biases the first projection piece 126 from the lower wall portion 85 toward the inside of the storage portion 84 via the opening 136. The second biasing member 128 is a torsion coil spring attached to an end portion 130A of the pivotal shaft 130. Near the end portion 130A, there is provided an attachment portion 139 to which an end of the second biasing member 128 is attached, and the other end abuts on the second movable portion 125 and biases the first projection piece 126 together with the second movable portion 125. That is, the second biasing member 128 biases the first projection piece 126 toward the entering attitude. When the first projection piece 126 in the entering attitude receives a downward pressing force from the inside of the storage portion 84, the second actuator 102 pivots, and the first projection piece 126 retreats from the opening 136 to outside. As the first projection piece 126 retreats, the second projection piece 127 enters the inside of the storage portion 84 from the opening 137.

It is noted that the second biasing member 128 is not limited to a torsion coil spring as far as it can elastically bias the first projection piece 126 of the second movable portion 125 from the lower wall portion 85 toward the inside of the storage portion 84. Springs and elastic members of various shapes and materials, such as a plate spring, are applicable to the second biasing member 128.

According to the present embodiment, since the second actuator 102 having the above-described configuration is provided in the storage portion 84, when the waste toner container 81 is inserted in the storage portion 84, the second protruding portion 62 of the support frame 59 abuts on the first projection piece 126. This causes the second actuator 102 to pivot, and the first projection piece 126 retreats from the opening 136 to outside. When the waste toner container 81 is inserted in the storage portion 84, if the first projection piece 126 abuts on the second protruding portion 62 after the opening 59A passes the second projection piece 127, the second actuator 102 permits the insertion of the waste toner container 81 in the storage portion 84. On the other hand, if the first projection piece 126 abuts on the second protruding portion 62 before the opening 59A passes the second projection piece 127, the second projection piece 127 is engaged with the opening 59A, and the insertion of the waste toner container 81 in the storage portion 84 is restricted (prohibited).

Figure 15A:
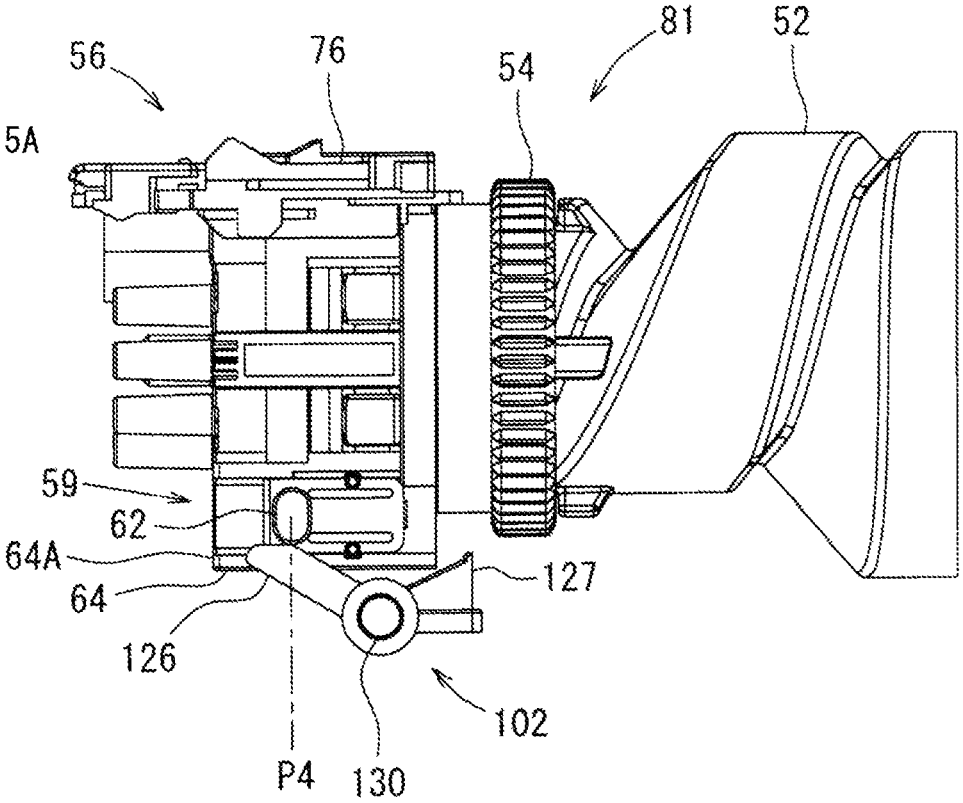
FIG. 15A and FIG. 15B are diagrams showing an operational relationship between the second actuator and the second protruding portion of the cover member.

Specifically, as shown in FIG. 15A, when a waste toner container 81 is attempted to be inserted in the storage portion 84 in the state where the second protruding portion 62 is disposed at the fourth position P4, the second protruding portion 62 abuts on the first projection piece 126. This causes the second actuator 102 to pivot. Subsequently, the first projection piece 126 projects from the opening 136 to outside of the lower wall portion 85, and the second projection piece 127 enters the inside of the storage portion 84. At this time, the second projection piece 127 is disposed more on the downstream side than the opening 59A in the removal direction D22, thus the second projection piece 127 is not engaged with the opening 59A. As a result, the waste toner container 81 is permitted to be inserted in the storage portion 84 without being restricted (prohibited) by the second projection piece 127, and is inserted to a predetermined attachment position in the storage portion 84.

Figure 15B:
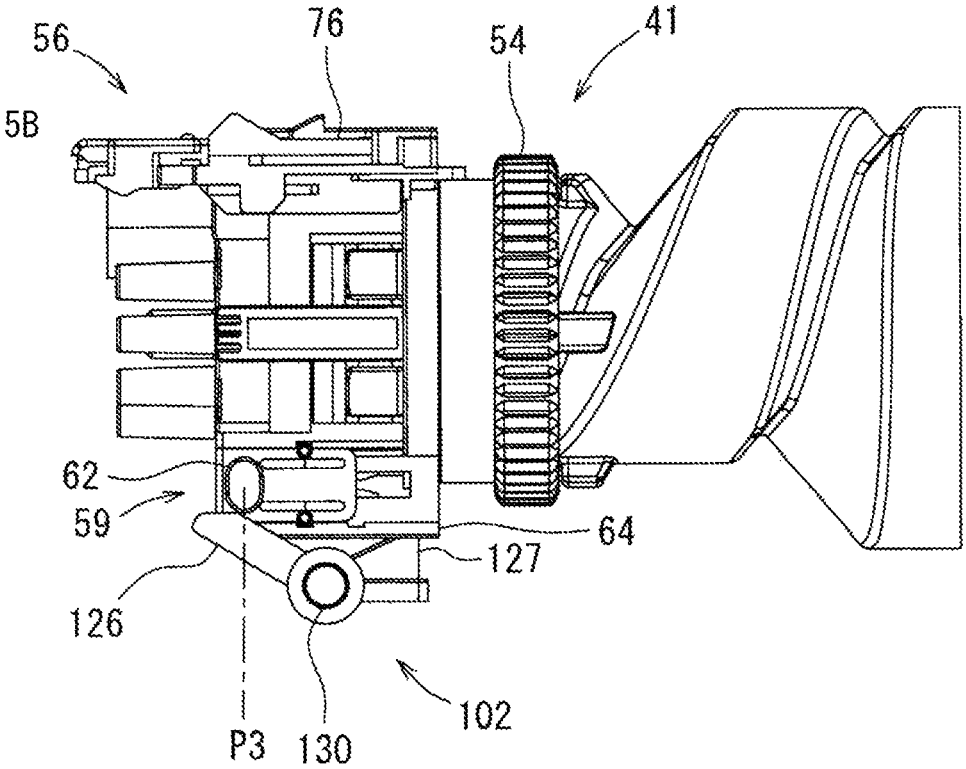

In addition, to prevent a new, unused toner container 41 from being erroneously attached to the waste toner collecting device 80, when the waste toner container 81 is attempted to be attached to the storage portion 84, the second actuator 102 acts on the second protruding portion 62 that is disposed at the third position P3, and restricts (prohibits) the attachment of the waste toner container 81. Specifically, as shown in FIG. 15B, when a toner container 41 is attempted to be inserted in the storage portion 84 in the state where the second protruding portion 62 is disposed at the third position P3, the second protruding portion 62 abuts on and causes the second actuator 102 to pivot. Subsequently, the first projection piece 126 projects from the opening 136 to outside of the lower wall portion 85, and the second projection piece 127 enters the inside of the storage portion 84. At this time, the second projection piece 127 enters the opening 59A and is engaged with the opening 59A. As a result, the second projection piece 127 restricts (prohibits) the toner container 41 from being inserted in the storage portion 84. This makes it possible to prevent a new, unused toner container 41 from being erroneously attached to the waste toner collecting device 80.

Figures 16A, 16B, 16C:
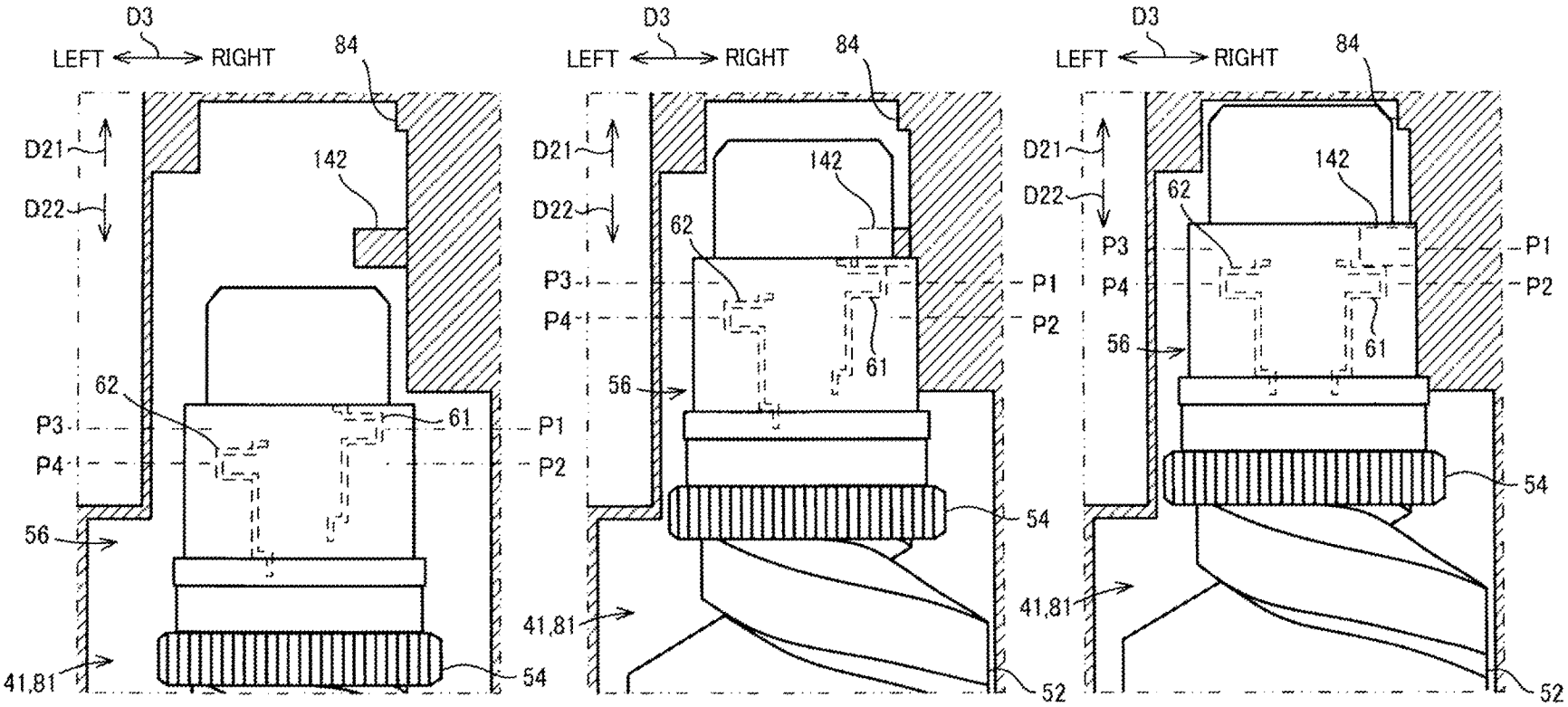
FIG. 16A, FIG. 16B, and FIG. 16C are diagrams showing an operational relationship between the first protruding portion of the cover member and a second pressing portion.

Here, as shown in FIG. 16A to FIG. 16C, the storage portion 84 includes a second pressing portion 142 (an example of the fourth actuating portion of the present invention). The second pressing portion 142 is a projection-like member that is integrally formed with the inner wall of the storage portion 84. During a process in which the waste toner container 81 is attached to the storage portion 84, the second pressing portion 142 acts on and switches the first protruding portion 61 disposed at the first position P1 to the second position P2 (see FIG. 16C). Specifically, the second pressing portion 142 presses the first protruding portion 61 frontward as the waste toner container 81 is attached to the storage portion 84 (see FIG. 16A, FIG. 16B). This allows the first protruding portion 61 to move from the first position P1 to the second position P2 (see FIG. 16C). That is, the first protruding portion 61 is switched from the first position P1 to the second position P2. According to the present embodiment, an empty container 41 that has become empty with the toner therein having been consumed completely in the toner replenishing device 40 can be used as a waste toner container 81. When the waste toner container 81 becomes full of waste toner, the waste toner container 81 is removed from the waste toner collecting device 80. To prevent the waste toner in the removed waste toner container 81 from being used in the toner replenishing device 40, the waste toner container 81 is configured such that it cannot be attached to the toner replenishing device 40 again. That is, the waste toner container 81 having been removed from the waste toner collecting device 80 is in the state (an example of the third state of the present invention) where the first protruding portion 61 has been moved from the first position P1 to the second position P2 by the second pressing portion 142. As a result, as described above, when a waste toner container 81 is in the state where the first protruding portion 61 is disposed at the second position P2, the waste toner container 81 is restricted (prohibited) by the first actuator 101 from being inserted in the storage portion 44A (see FIG. 11A to FIG. 11C). That is, a removed waste toner container 81 cannot be attached to the storage portion 44A if it is in the state where the first protruding portion 61 is disposed at the second position P2. As a result, it is possible to prevent waste toner from being used by preventing the waste toner container 81 from being re-attached.

The invention claimed is:

1. An image forming apparatus comprising:

a toner replenishing portion;

a waste toner collecting portion; and a toner container configured to be attachable to and detachable from the toner replenishing portion and the waste toner collecting portion, wherein the toner container includes:

a first lever configured to be switchable between a first position and a second position; and a second lever configured to be switchable between a third position and a fourth position, the toner replenishing portion includes:

a first actuating portion configured to, during a process in which the toner container is attached to the toner replenishing portion, act on the toner container in which the first lever is disposed at the second position and prohibit an attachment of the toner container; and a second actuating portion configured to, during the process in which the toner container is attached to the toner replenishing portion, act on the second lever disposed at the third position and switch the second lever to the fourth position, and the waste toner collecting portion includes:

a third actuating portion configured to, during a process in which the toner container is attached to the waste toner collecting portion, act on the second lever disposed at the third position and prohibit an attachment of the toner container; and a fourth actuating portion configured to, during the process in which the toner container is attached to the waste toner collecting portion, act on the first lever disposed at the first position and switch the first lever to the second position.

2. The image forming apparatus according to claim 1, wherein during a process in which the toner container that is in a first state where the first lever is disposed at the first position and the second lever is disposed at the third position, is attached to the toner replenishing portion, the second lever is switched to the fourth position by an action of the second actuating portion, and the toner container becomes in a second state where the toner container is attachable to the toner replenishing portion and the waste toner collecting portion, and during a process in which the toner container that is in the second state is attached to the waste toner collecting portion, the first lever is switched to the second position by an action of the fourth actuating portion, and the toner container becomes in a third state where the toner container is not attachable to the toner replenishing portion.

3. The image forming apparatus according to claim 1, wherein the second actuating portion presses the second lever and causes the second lever to move from the third position to the fourth position as the toner container is attached to the toner replenishing portion, the fourth actuating portion presses the first lever and causes the first lever to move from the first position to the second position as the toner container is attached to the waste toner collecting portion, the first actuating portion acts on the first lever at the first position so as to permit an attachment of the toner container to the toner replenishing portion, and acts on the first lever at the second position so as to prohibit an attachment of the toner container to the toner replenishing portion, and the third actuating portion permits an attachment of the toner container to the waste toner collecting portion when the second lever is at the fourth position, and prohibits an attachment of the toner container to the waste toner collecting portion when the second lever is at the third position.

4. The image forming apparatus according to claim 3, wherein the toner container includes a support portion having a pair of support surfaces that are located away from each other in a perpendicular direction perpendicular to an attachment direction to the toner replenishing portion and to the waste toner collecting portion, the first lever being supported by one of the pair of support surfaces, the second lever being supported by the other of the pair of support surfaces, the toner replenishing portion includes a first storage portion configured to store the toner container that has been inserted in the attachment direction, the first actuating portion includes:

a first movable portion configured to enter from an upper wall of the first storage portion to an inside of the first storage portion and retreat therefrom;

a first abutting portion provided on the first movable portion and configured to abut on a forward end of the support portion in the attachment direction;

a second abutting portion projecting from the first abutting portion in a removal direction in which the toner container is removed from the toner replenishing portion, and configured to abut on the first lever; and a first biasing member configured to bias the first movable portion from the upper wall toward the inside, wherein when the toner container is attempted to be inserted in the first storage portion, the first actuating portion permits an insertion of the toner container in the first storage portion in a case where the second abutting portion abuts on the first lever before the first abutting portion abuts, and prohibits an insertion of the toner container in the first storage portion in a case where the first abutting portion abuts on the forward end before the second abutting portion abuts.

5. The image forming apparatus according to claim 4, wherein when the toner container in a state where the first lever is at the first position is inserted in the first storage portion, the second abutting portion abuts on the first lever to cause the first movable portion to retreat from the upper wall to outside so as to permit an insertion of the toner container, and when the toner container in a state where the first lever is at the second position is inserted in the first storage portion, the first abutting portion abuts on the forward end so as to prohibit an insertion of the toner container.

6. The image forming apparatus according to claim 4, wherein the first movable portion is pivotably supported by the upper wall with the perpendicular direction as a pivotal axis.

7. The image forming apparatus according to claim 3, wherein the toner container includes a support portion having a pair of support surfaces that are located away from each other in a direction perpendicular to an attachment direction to the toner replenishing portion and to the waste toner collecting portion, the first lever being supported by one of the pair of support surfaces, the second lever being supported by the other of the pair of support surfaces, the waste toner collecting portion includes a second storage portion configured to store the toner container that has been inserted in the attachment direction, the support portion includes a restriction portion provided between the pair of support surfaces in such a way as to face a lower wall of the second storage portion, the third actuating portion includes:

a second movable portion having a first projection piece configured to enter from the lower wall of the second storage portion to an inside of the second storage portion and retreat therefrom;

a second projection piece provided on the second movable portion and configured to project to outside from the lower wall when the first projection piece enters the inside of the second storage portion, and enter the inside of the second storage portion and be engaged with the restriction portion when the first projection piece projects to outside from the lower wall; and a second biasing member configured to bias the first projection piece from the lower wall toward the inside, and when the toner container is attempted to be inserted in the second storage portion: in a case where the first projection piece abuts on the second lever after the restriction portion passes the second projection piece, the third actuating portion permits an insertion of the toner container in the second storage portion; and in a case where the first projection piece abuts on the second lever before the restriction portion passes the second projection piece, the second projection piece is engaged with the restriction portion and prohibits an insertion of the toner container in the second storage portion.

8. The image forming apparatus according to claim 7, wherein when the toner container in a state where the second lever is at the fourth position is inserted in the second storage portion, the second movable portion abuts on the second lever to cause the first projection piece to project to outside from the lower wall and cause the second projection piece to enter the inside of the second storage portion so that the second projection piece is disposed more on a downstream side than the restriction portion in a removal direction in which the toner container is removed from the toner replenishing portion, thereby permitting an insertion of the toner container, and when the toner container in a state where the second lever is at the third position is inserted in the second storage portion, the second movable portion abuts on the second lever to cause the first projection piece to project to outside from the lower wall and cause the second projection piece to enter the inside of the second storage portion so that the second projection piece is engaged with the restriction portion in the attachment direction, thereby prohibiting an insertion of the toner container.

9. The image forming apparatus according to claim 8, wherein the support portion has a facing surface that faces the lower wall of the second storage portion, and the restriction portion is a through opening which is formed in the facing surface and in which the second projection piece can be inserted.

10. The image forming apparatus according to claim 7, wherein the second movable portion is pivotably supported by the lower wall with the perpendicular direction as a pivotal axis.

* * * * *